United States Patent [19]

Ishibashi, deceased

[11] Patent Number: 4,479,411

[45] Date of Patent: Oct. 30, 1984

[54] TONE SIGNAL GENERATING APPARATUS OF ELECTRONIC MUSICAL INSTRUMENTS

[75] Inventor: Masanori Ishibashi, deceased late of Tokyo, Japan by Masayuki Ishibashi, legal representative

[73] Assignee: Casio Computer Co., Ltd., Tokyo, Japan

[21] Appl. No.: 450,082

[22] Filed: Dec. 15, 1982

[30] Foreign Application Priority Data

| | | | |
|---|---|---|---|
| Dec. 22, 1981 | [JP] | Japan | 56-208814 |
| Dec. 22, 1981 | [JP] | Japan | 56-208815 |
| Dec. 22, 1981 | [JP] | Japan | 56-208816 |
| Apr. 8, 1982 | [JP] | Japan | 57-57359 |

[51] Int. Cl.[3] ..... G10H 1/02; G10H 7/00

[52] U.S. Cl. ..... 84/1.01; 84/1.24

[58] Field of Search ..... 84/1.01, 1.24, 1.25, 84/1.26

[56] References Cited

U.S. PATENT DOCUMENTS

| | | | |
|---|---|---|---|
| 4,026,180 | 5/1977 | Tomisawa et al. | 84/1.01 X |
| 4,119,005 | 10/1978 | Kondo et al. | 84/1.01 |
| 4,127,047 | 11/1978 | Tomisawa | 84/1.01 |
| 4,135,424 | 1/1979 | Okamoto | 84/1.26 X |
| 4,205,575 | 6/1980 | Hoskinson et al. | 84/1.01 |
| 4,240,318 | 12/1980 | Gross | 84/1.01 |
| 4,342,245 | 8/1982 | Gross | 84/1.01 |
| 4,344,343 | 8/1982 | Deforeit | 84/1.01 |
| 4,387,622 | 6/1983 | Deutsch | 84/1.01 X |
| 4,406,204 | 9/1983 | Katoh | 84/1.01 X |
| 4,422,362 | 12/1983 | Chibana | 84/1.24 X |
| 4,445,414 | 5/1984 | Smith | 84/1.01 |

FOREIGN PATENT DOCUMENTS 53892 6/1982 European Pat. Off. .

*Primary Examiner*—S. J. Witkowski

*Attorney, Agent, or Firm*—Frishauf, Holtz, Goodman & Woodward

[57] ABSTRACT

Code data representing a plurality of note frequencies are stored in a first ROM and are selectively read out according to key operation of a keyboard. With the operation of a key, predetermined control data is also obtained, and this control data is cumulatively added to or subtracted from the code data as an initial value, whereby a note frequency signal corresponding to the operated key is obtained. Portions of the waveform of the resultant note frequency signal where there is a sharp change in amplitude are interpolated with a sine wave stored in a second ROM.

19 Claims, 37 Drawing Figures

FIG. 20
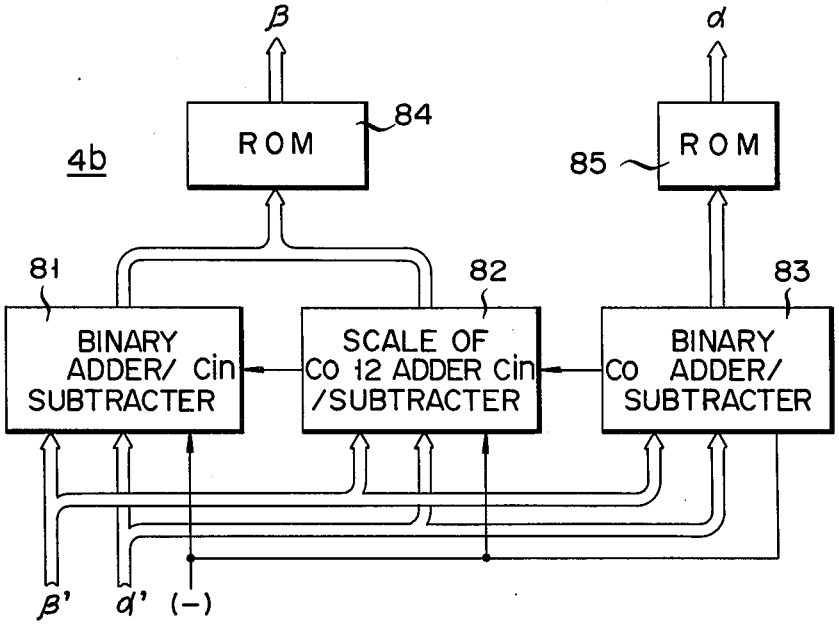
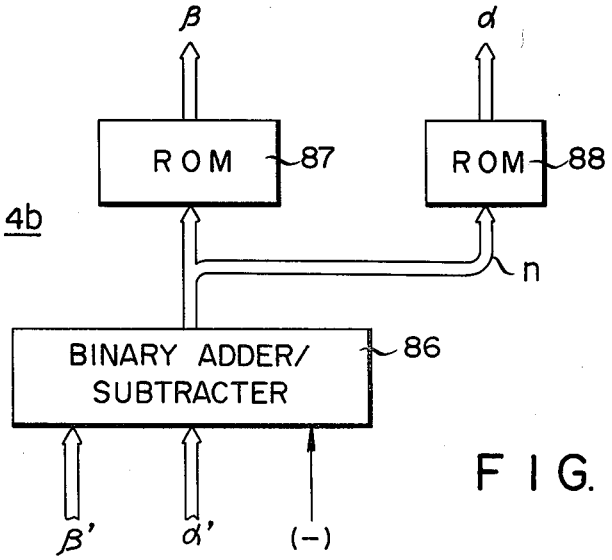
FIG. 21

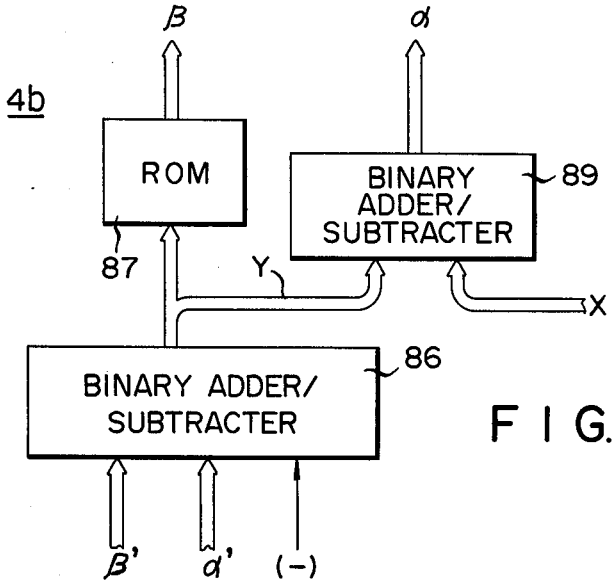
FIG. 22
FIG. 23
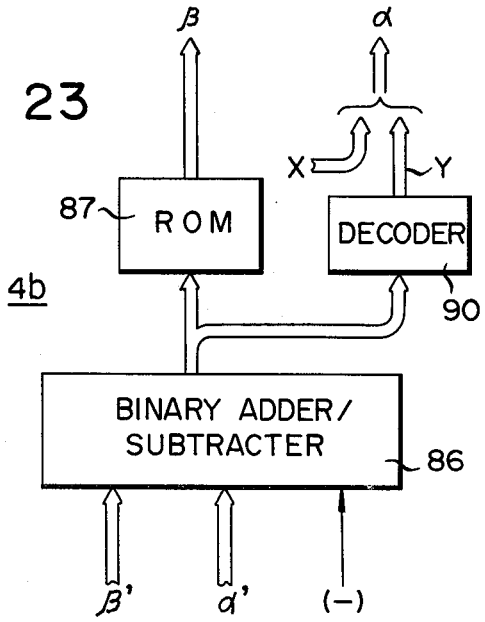

TONE SIGNAL GENERATING APPARATUS OF ELECTRONIC MUSICAL INSTRUMENTS

BACKGROUND OF THE INVENTION

This invention relates to electronic musical instruments and, more particularly, to a tone signal generating apparatus using a digital circuit for electronic musical instruments or the like.

The use of a digital circuit for an electronic musical instrument has various advantages such as the possibility of simultaneously generating a plurality of tones through a time division basis process, the possibility of accurately setting tone frequencies and the possibility of simplifying the circuit construction by using analog circuitry.

In one method of digitally obtaining tone signals, an ROM with tone waveform data preliminarily written therein is used. To obtain a tone signal, addresses of the ROM are designated by the output of an address counter according to operated keys, and tone waveform data corresponding to the given musical notes are read out from the ROM. In this system, however, the ROM address to be designated is fixed irrespective of the tone frequency, that is, the tone waveform is sampled at a fixed point. Particularly, in case of a tone waveform in a high tone range, folding distortion is liable to occur due to sampling theory. A so-called jitter also can be generated when the same address is designated a plurality of times in succession. In order to solve these problems it is necessary to use a ROM having a very large memory capacity. It is conceivable to vary the address step interval for varying the sampling point of the waveform. To do so, however, has a drawback in that the tone color is varied slightly with each musical note.

SUMMARY OF THE INVENTION

An object of the invention is to provide a tone signal generating apparatus for an electronic musical instrument which can generate tone signals with a digital circuit which does not use a large memory capacity ROM.

According to one aspect of this invention, the above object can be attained by a tone signal generating apparatus for an electronic musical instrument, which comprises means for storing code data indicative of a plurality of musical note frequencies, means for reading out given code data from the storing means according to the operation of keys on a keyboard, arithmetic means for performing predeterined arithmetic operations to obtain an output consisting of a plurality of bits indicative of a note frequency corresponding to an operated key, control means for forming a tone signal having a predetermined waveform from the output of the arithmetic means, and an interpolating means for interpolating portions of the waveform where sudden changes of the amplitude of the tone signal occur with predetermined function curves.

BRIEF DESCRIPTION OF THE DRAWINGS

FIG. 20 is a block diagram showing an example of an average factor frequency arithmetic section in FIG. 19;

FIGS. 21 to 26 are block diagrams showing different examples of the average factor frequency arithmetic section;

DETAILED DESCRIPTION OF THE PREFERRED EMBODIMENTS

Figure 1:
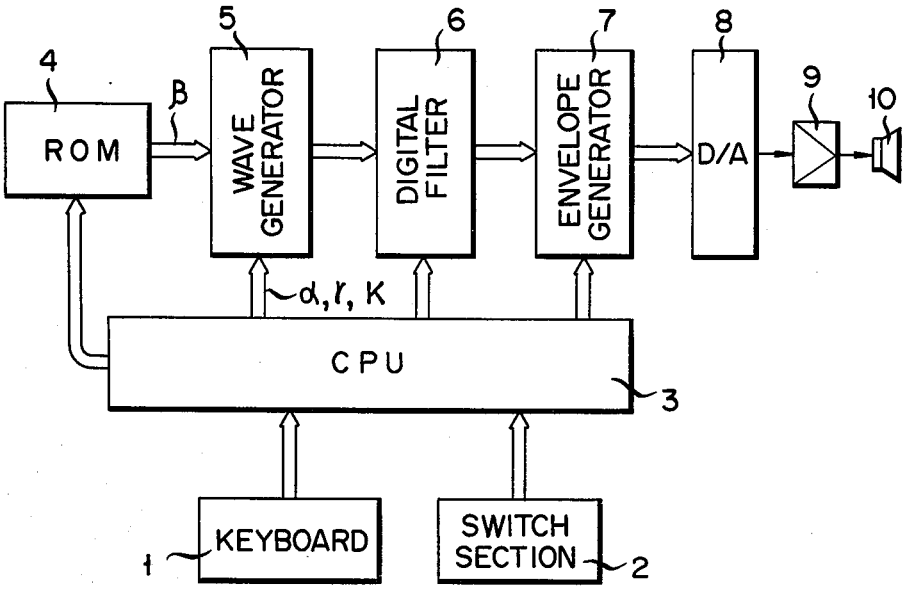
FIG. 1 is a system block diagram showing an embodiment of the invention.

FIG. 1 shows a block diagram of a music synthesizer embodying the invention. The system includes a keyboard 1 which has a plurality of keys. When each key is operated, a key operation signal is produced. The system also includes a switch section 2, which includes switches for selecting various tone waveforms (basic waveforms) such as rectangular waveforms, PWM waveforms, non-symmetric waveforms and sawtooth waveforms and also switches for controlling a digital filter 6 and an envelope generator 7 to be described later. The outputs from the keyboard 1 and switch section 2 are both supplied to a CPU (central processing unit) 3.

The CPU 3 can control all the operations of the music synthesizer, and it consists of a microprocessor, which is not described in detail.

An ROM (read only memory) 4 is a memory in which note frequency code data $\beta$ are stored. Address data for reading out tone frequency code data corresponding to operated keys on the keyboard 1 from the ROM 4 is supplied from the CPU 3 to the ROM 4. The read-out note frequency code data $\beta$ is supplied to a wave generator 5.

The wave generator 5 is a circuit which forms a tone waveform through a digital processing on the note frequency code data $\beta$ and data $\alpha$, $\gamma$ and K supplied from the CPU 3. The waveform data thus obtained is supplied to a digital filter 6. The digital filter 6 removes some of the harmonic components in the waveform data according to a control signal from the CPU 3, and its output is supplied to an envelope generator 7. The envelope generator 7 gives an envelope to the output of the digital filter 6 according to the control signal from the CPU 3 to produce a tone signal. The tone signal thus produced is supplied to a digital/analog converter 8. The digital/analog converter 8 is a circuit to convert the input tone signal, which is a digital signal, to an analog tone signal. The analog tone signal thus produced is coupled through an ampifier 9 and a loudspeaker 10 connected to the output side of the digital/analog converter 8, whereby the corresponding musical sound is produced. As the digital filter 6, a digital filter disclosed in U.S. Patent Application Ser. No. 256,187 now U.S. Pat. No. 4,422,156 may be used, and as the envelope generator 7, that disclosed in U.S. Patent Application Ser. No. 287,691 filed July 28, 1981, may be used.

Figure 2A:
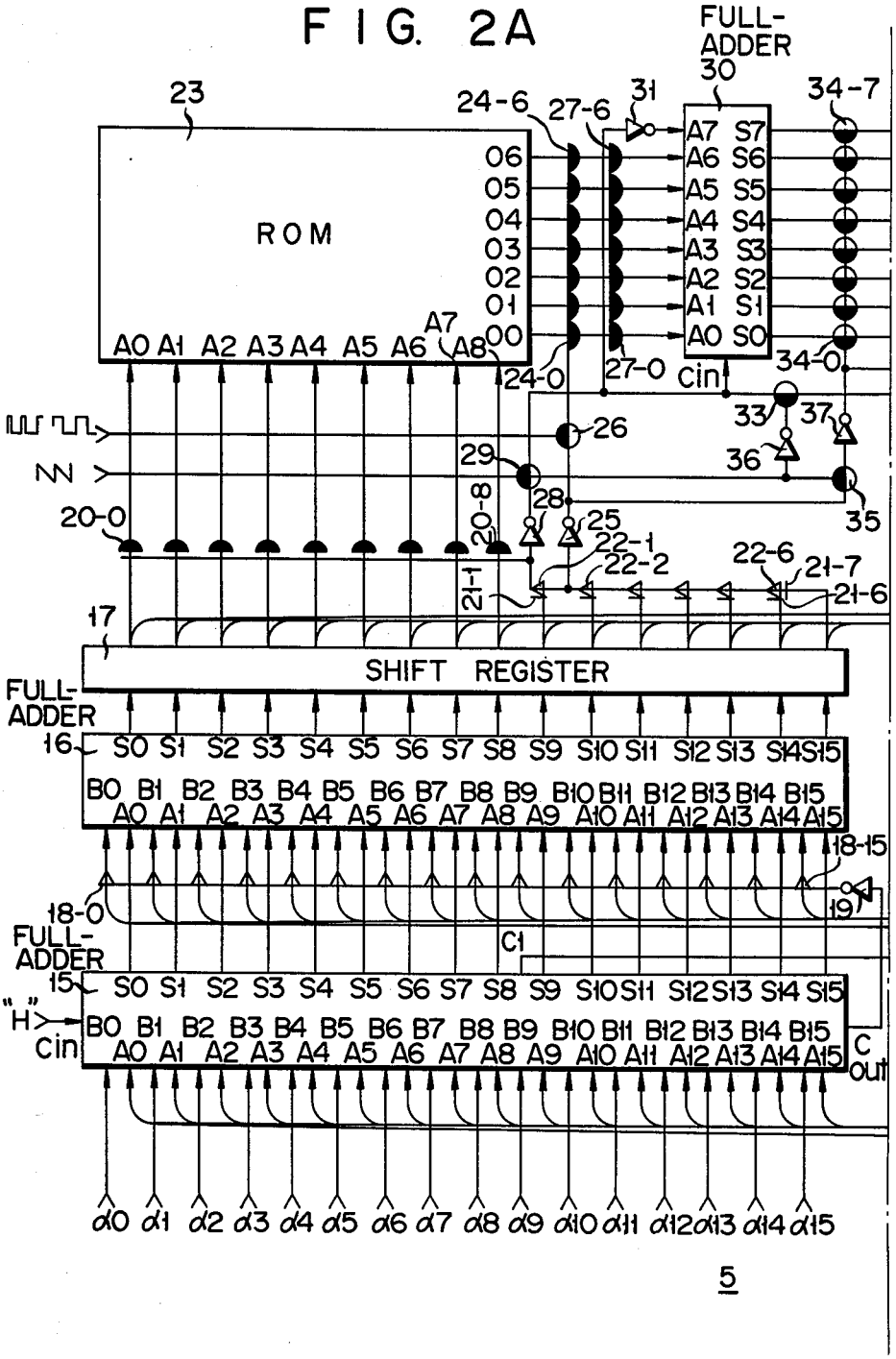
FIGS. 2A and 2B together form a circuit diagram showing a wave generator in the system shown in FIG. 1.
Figure 2B:
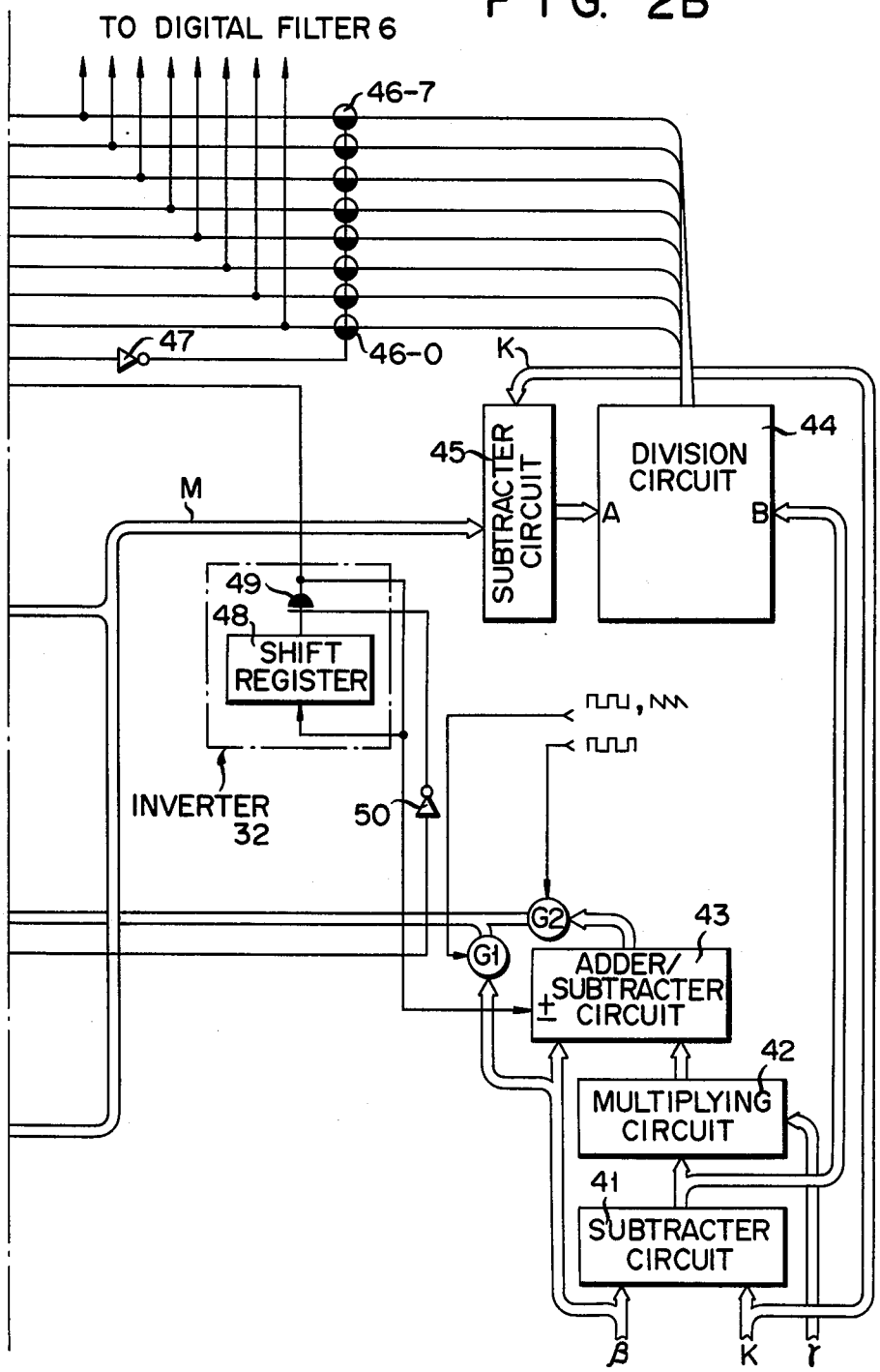

FIGS. 2A and 2B together show the specific construction of the wave generator 5. A shift register 17 (FIG. 2A) provides 16-bit data, which is fed to A input terminals A15 to A0 of a full-adder 15 to be circulated to the shift register 17. Fixed 16-bit data $\alpha$ ($\alpha$15 to $\alpha$0) is fed from the CPU 3 to B input terminals B15 to B0 of the full-adder 15. A high level signal "H" is always applied to a terminal $C_{in}$ of the full-adder 15. The full-adder 15 subtracts the input data $\alpha$ to the B input terminals from the input data to the A input terminals to produce result data from its S output terminals S15 to S0. The output data is fed to A input terminals A15 to A0 of a full-adder 16, which is connected to the output side of the full-adder 15. B input terminals B15 to B0 of the full-adder 16 are coupled through AND gates 18-15 to 18-0 to note frequency code data $\beta$ from a gate circuit G1 shown in FIG. 2B (in case of forming a rectangular wave or a sawtooth wave) and to data $\beta\pm(\beta-K)$ and $\gamma$ from a gate circuit G2. These data are preset in the full-adder 16. A carry output from a terminal count of the full-adder 15 is coupled through an inverter 19 to a control input terminal of each of the AND gates 18-15 to 18-0.

The result data produced from S output terminals S15 to S0 of the full-adder 16 is fed to the shift register 17, which is connected to the output side of the full-adder 16. If the music synthesizer is an eight-tone polyphonic music synthesizer, the register 17 consists of eight stages of 16-bit shift registers connected in cascade. The circuit of FIGS. 2A and 2B performs time division basis operations under the control of the CPU 3.

Of the output data from the shift register 17, lower 9-bit data from the output terminals S8 to S0 is fed to exclusive OR gates 20-8 to 20-0, while higher 6-bit data from the output terminals S9 to S14 is fed through inverters 21-1 to 22-6 to control input terminals of AND gates 22-1 to 22-6. Further, the most significant bit data from the output terminals S51 is fed through an inverter 21-7 to the other input terminal of the AND gate 22-6. The AND gates 22-1 to 22-6 are serially connected as is shown in FIG. 2A; that is, the output of the AND gate 22-6 is fed to the other input terminal of the AND gate 22-5, and similarly the outputs of the AND gates 22-5 to 22-2 are fed to the other input terminals of the succeeding AND gates 22-4 to 22-1. The output of the AND gate 22-1 is fed to exclusive OR gates 20-8 to 20-0.

Figure 3:
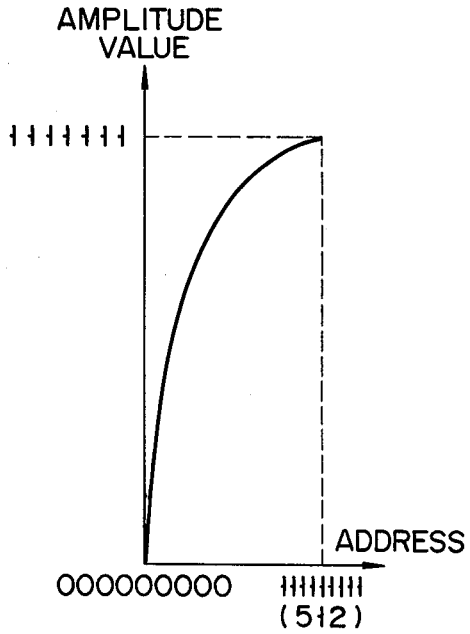
FIG. 3 is a view showing a waveform stored in a ROM in the system of FIG. 1.

The outputs of the exclusive OR gates 20-8 to 20-0 are fed as address data to A input terminals A8 to A0 of a ROM 23. In the ROM 23, quarter sine wave data as shown in FIG. 3 is stored. This waveform data is used for interpolating a portion of the output waveform data such as for a rectangular wave produced from the wave generator 5 where there is a sudden change in the amplitude level. From output terminals $O_6$ to $O_0$ of the ROM 23, 7-bit waveform data which is fed to OR gates 24-6 to 25-0 is read out.

To the OR gates 24-6 to 24-0 the output of the AND gate 22-2 is directed through an inverter 25 and a transfer gate 26. The outputs of the OR gates 24-6 to 24-0 are fed to one input terminal of respective exclusive OR gates 27-6 to 27-0. To the other terminal of the exclusive OR gates 27-6 to 27-0 the output of the AND gate 22-1 is directed through an inverter 28 and a transfer gate 29. The outputs of the exclusive OR gates 27-6 to 27-0 are fed to A input terminals A6 to A0 of a full-adder 30, which constitutes a polarity inverter. To an A input terminal A7 of the full-adder 30 the output of the AND gate 22-1 is directed through the inverter 28 and the transfer gate 29. To an input terminal $C_{in}$ of the full adder 30 the output of the AND gate 22-1 is directed through the inverter 28 and transfer gate 29. Also, to the input terminal $C_{in}$ the output of an inverter 32 (FIG. 2B) is directed through a transfer gate 33. Data provided from output terminals S7 to S0 of the full-adder 30 is coupled through transfer gates 34-7 to 34-0 to the digital filter 6.

When a switch for specifying a rectangular wave or a switch for specifying a PWM wave is operated, the transfer gate 26 is controlled for gating by a control signal which is provided from the CPU 3 and fed to its control input terminal. When a switch for specifying a sawtooth wave is operated, the transfer gates 29 and 35 are controlled for gating by a control signal which is provided from the CPU 3 and fed to their control input terminals. The transfer gate 33 is controlled for gating by a signal fed to it through an inverter 36. The transfer gates 34-7 to 34-0 are operated for gating by the output of the AND gate 22-2 directed to their control input terminals through the inverter 25, transfer gate 35 and inverter 37.

The note frequency code data $\beta$ and data K (which is a fixed data) are supplied to a subtracter circuit 41, as shown in FIG. 2B. The resultant data $\beta-K$ from the subtracter circuit 41 is fed to both a multiplying circuit 42 and a division or dividing circuit 44. The multiplying circuit 42 also receives the data $\gamma$ (which assumes a value of $0\leqq\gamma\leqq1$ and determines the duty ratio), and its resultant data $\beta-K$ is fed to an adder/subtracter circuit 43. The adder/subtracter circuit 43 also receives the note frequency code data $\beta$, and the output of the inverter 32 is fed to a plus/minus control input terminal of the adder/subtracter 43. The result data $\beta\pm(\beta-K)\cdot\gamma$ is fed to the gate circuit G2. When a switch for specifying a rectangular wave or a switch for specifying a sawtooth wave is operated, the gate circuit G1 is operated for gating by a control signal provided from the CPU 3. When a switch for specifying a PWM wave is operated, the gate circuit G2 is operated for gating by a control signal from the CPU 3.

The output data M from the shift register 17 and data K from the CPU 3 are fed to a subtracter circuit 45. The result data from the subtracter circuit 45 is fed to the dividing circuit 44. The result data $(M-K)/(\beta-K)$ of the dividing circuit 44 is coupled through transfer gates 46-7 to 46-0 to be fed as sawtooth wave data to the digital filter 6. The transfer gates 46-7 to 46-0 are operated for gating by the output of the AND gate 22-2 (FIG. 2A) to their control input terminals through inverter 25, transfer gate 35 and inverters 37 and 47.

The inverter 32 in FIG. 2B includes a shift register 48 and an exclusive OR gate 49 connected to the output side of the shift register 48. The output of an output terminal C1 of the full-adder 15 (FIG. 2A) is directed through an inverter 50 to the other input terminal of the exclusive OR gate 49. The output of the exclusive OR gate 49 is fed back to the input side of the shift register 48. If the music synthesizer is the 8-tone polyphonic synthesizer as noted above, the shift register 48 consists of eight stages of one-bit shift registers connected in cascade. When the result data of the full-adder 15 reaches "512", and "H" level signal (i.e., a carry) is provided from the output terminal C1 of the full-adder 15.

The operation of this embodiment will now be described with reference to FIGS. 4 to 14. First, the operation is described in connection with the case in which the wave generator 5 produces a rectangular wave with reference to the time chart of FIG. 4. In this case, the rectangular wave specification switch and other necessary switches in the switch section 2 are turned on. When the rectangular wave specification switch is turned on, the CPU 3 supplies an "H" (i.e., "1") level or "L" (i.e., "0") level signal to the gate circuits G1 and G2 of the wave generator 5 (FIG. 2B). As a result, the gate circuit G1 is enabled while the gate circuit G2 is disabled. The CPU 3 also supplies a "1" level signal to the transfer gate 26 and a "0"0 level signal to the transfer gates 29 and 35 in FIG. 2A. As a result, the transfer gate 26 is enabled while the transfer gates 29 and 35 are disabled. With the transfer gates 29 and 35 enabled, the transfer gate 33 and transfer gates 34-7 to 34-0 are enabled while the transfer gates 46-7 to 46-0 are disabled.

It is now assumed that, for example, one key on the keyboard 1 is turned on in this state. When the key is turned on, the CPU 3 provides a predetermined address data to the ROM 4 FIG. 1 for reading out note frequency code data $\beta$ corresponding to the operated key from the ROM 4. As a result, the note frequency code data $\beta$ is read out from the ROM 4 and fed to the wave generator 5. The note frequency code data $\beta$ is coupled through the gate circuit G1, which is in the open state, to the AND gates 18-15 to 18-0. At this moment, the output from the output terminal $C_{out}$ of the full-adder 15 is "0", that is, the output of the inverter 19 is "1", so that the AND gates 18-15 to 18-0 are in the open state. Thus, the note frequency code data $\beta$ is passed through the AND gates 18-15 to 18-0 to the B input terminals B15 to B0 of the full-adder 16. Meanwhile, 16-bit all "0" data is fed at this time from the S output terminals S15 to S0 of the full-adder 15 to the A input terminals A15 to A0 of the full-adder 16. Thus, data of the same value as the preset note frequency code data $\beta$ noted above is provided at this time as the result data from the S output terminals S15 to S0 of the full-adder 16 to be fed to the shift register 17. As the data is shifted through the shift register 17 and provided therefrom, it is circulated to the A input terminals A15 to A0 of the full-adder 15, while it is also coupled through the exclusive OR gates 20-8 to 20-0 and inverters 21-7 to 21-1.

In this embodiment, the note frequency code data $\beta$ for the individual notes all have values greater than "1,024". In other words, data "1" is always contained in the upper six bits up to the uppermost bit in the 16-bit data. Thus, when the note frequency code data $\beta$ is set with the turning-on of one key mentioned above and the same data is subsequently provided from the shift register 17, the output of the AND gate 22-2 is always at the "0" level as shown in (e) in FIG. 4. The output of the AND gate 22-1 thus is also at the "0" level while the output of the AND gate 22-2 is "0" as shown in (b) in FIG. 4. Further, the output of the inverter 50 is at the "1" level at this time as shown in (c) in FIG. 4, so that the output of the inverter 32 is at the "0" level as shown in (d) in FIG. 4. Thus, the "0" level signal of the AND gate 22-1 is supplied to the exclusive OR gates 20-8 to 20-0, and the lower 9-bit data of the output of the shift register 17 is directly fed to the A input terminals A8 to A0 of the ROM 23. Further, the "0" level signal of the AND gate 22-2 is inverted through the inverter 25, and the "1" level signal therefrom is fed to the OR gates 24-6 to 24-0. A "1" level signal is thus provided from each of the OR gates 24-6 to 24-0 to be fed to one input terminal of each of the exclusive OR gates 27-6 to 27-0. A "0" level signal is thus fed as the output of the inverter 32 to the other input terminal of each of the exclusive OR gates 27-6 to 27-0. The exclusive OR gates 27-6 to 27-0 thus all provide a "1" level signal. The output of the inverter 31 is also at the "1" level. Thus, all "1" data is fed to the A input terminals A7 to A0 of the full-adder 30. The output of the inverter 32 (i.e., "0" level signal) is further fed to the carry input terminal $C_{in}$ of the full-adder 30. The result data from the S output terminals S7 to S0 of the full-adder 30 is thus provided at this time as 8-bit all "1" data. This data is coupled through the transfer gates 34-7 to 34-0, which are in the open state at this time, to the digital filter 6. The rectangular wave supplied to the digital filter 6 has a waveform as shown in (a) in FIG. 4. The digital filter 6 removes harmonic components specified under the control of the CPU 3. The envelope generator 7 gives an envelope to the output of the digital filter 6, whereby the tone signal of the note corresponding to the operated key is produced to produce sound.

When the data of the same value as the preset note frequency code data $\beta$ is circulated to the A input terminals A15 to A0 of the full-adder 15, the fixed data $\alpha$ provided from the CPU 3 prevails as 16-bit data at the B input terminals B15 to B0 of the full-adder 15. Further, since the carry input terminal $C_{in}$ is always at the "H" level, the full-adder 15 executes at this time a first subtracting operation of $\beta-\alpha$ and provides the result data from the S output terminals to the A input terminals of the full-adder 16. The term "$-\alpha$" in the above formula "$\beta-\alpha$" corresponds to what is obtained by incrementing "$-1$" to the values of $\alpha 0, \alpha 1, \ldots, \alpha 15$ in FIG. 2A. At the time of the execution of this subtracting operation, the output from the carry output terminal $C_{out}$ of the full-adder 15 thus goes to "1" so that the output of the inverter 19 goes to "0" to close the AND gates 18-15 to 18-0. Thus, the input of the note frequency code data $\beta$ to the B input terminals of the full-adder 16 is inhibited. The result data from the full-adder 15 is thus the same as the result data obtained in the first subtracting operation in the full-adder 15. This data is fed to the shift register 17. The result data of the first subtracting operation, provided from the shift register 17, is fed to the exclusive OR gates 20-8 to 20-0 and inverters 21-7 to 21-1 while it is circulatedly fed to the inverters 21-7 to 21-1. The data prevailing at the A input terminals and carry input terminal $C_{in}$ of the full-adder 30 after the first calculation is ended are the same as before, so that 8-bit all "1" data is fed to the digital filter 6. In the full-adder 15, AND gates 18-15 to 18-0, full-adder 15 and shift register 17, the same cumulative subtracting operation as the first substracting operation described above is subsequently repeated until the result data, i.e., the output of the shift register 17, reaches "1,024" (see (f) in FIG. 4). During this time, the data at the A input terminal and carry input terminal $C_{in}$ of the full-adder 30 remain the same, so that the 8-bit all "1" data is continually fed to the digital filter 6. If the output of the shift register 17 becomes less than "1,024" in the next subtracting operation, it means that the upper 6-bit data in the output of the shift register 17 becomes all "0". Thus, at this time the output of the AND gate 22-2 is inverted to "1" as shown in (e) in FIG. 4. Thus, the output of the inverter 25 fed to the OR gates 24-6 to 24-0 goes to "0".

During the cumulative subtracting operation, from the instant when the output of the shift register 17 is "1,024" till the instant when the output is "512", the 10-th bit data in the output of the shift register 17 remains "1". During this time, the output of the AND gate 22-1 fed to the exclusive OR gates 20-8 to 20-0 remains "0". That is, during the period from the instant when the output is "1,024" till the instant when the output is "512", the lower 9-bit data in the output of the shift register 17 is continually fed to the A input terminals of the ROM 23. Further, during this time the output of the inverter 32 remains "0".

At an instant when the output of the shift register 17 is less than "1,024", for instance "1,023", the lower 9-bit data in the output of the shift register 17 fed to the A input terminals of the ROM 23 is all "1" data. The ROM 23 is address-designated by this 9-bit all "1" data, so that 7-bit all "1" data is read out as shown in FIG. 3. The 7-bit all "1" data is coupled through the OR gates 24-6 to 24-0 to the exclusive OR gates 27-6 to 27-0. At this time, the data input to the exclusive OR gates 27-6 to 27-0 and the carry input terminal $C_{in}$ of the full-adder 30 is still at the "0" level as mentioned earlier. Thus, 8-bit all "1" data is fed to the A input terminals of the full-adder 30, and the result data therefrom is provided as 8-bit all "1" data, which is fed to the digital filter 6.

When the output of the shift register 17 is further reduced from "1,023" by $\alpha$ in the next cumulative subtracting operation, the ROM 23 is address-designated by address data which is less than the previous 9-bit all "1" data (i.e., data "511") by $\alpha$. Thus, data less than the aforementioned 7-bit all "1" data by a predetermined value, i.e., data of an amplitude value slightly less than the data in the previous operation, is provided read out from the ROM 23, as is seen from FIG. 3. This amplitude value data is fed to the digital filter 6 without being inverted through the full-adder 30.

In this way, the output of the shift register 17 is progressively reduced by units of $\alpha$ in the cumulative subtracting operation. The ROM 23 is thus address-designated by address data which is progressively reduced by $\alpha$ until "512" is reached. Every time the address data is reduced, amplitude data of a value less than that of the previous data is read out. During this time, the data input to the A input terminals and carry input terminal $C_{in}$ of the full-adder 30 is the same as noted before, and progressively reducing amplitude value data is fed to the digital filter 6. When the output of the shift register 17 is "512", the ROM 23 is address-designated by 9-bit all "0" address data.

When the result data in the cumulative subtracting operation in the full-adder 15 changes from "512" to "511", a "1" signal is provided from the output terminal C1 of the full-adder 15. As a result, a one-shot pulse signal is provided from the inverter 50 as shown in (c) in FIG. 4. Thus, the output of the inverter 32 fed to the exclusive OR gates 27-6 to 27-0, inverter 31 and carry input terminal $C_{in}$ of the full-adder 30 is inverted to "1" as shown in (d) in FIG. 4.

Figure 4:
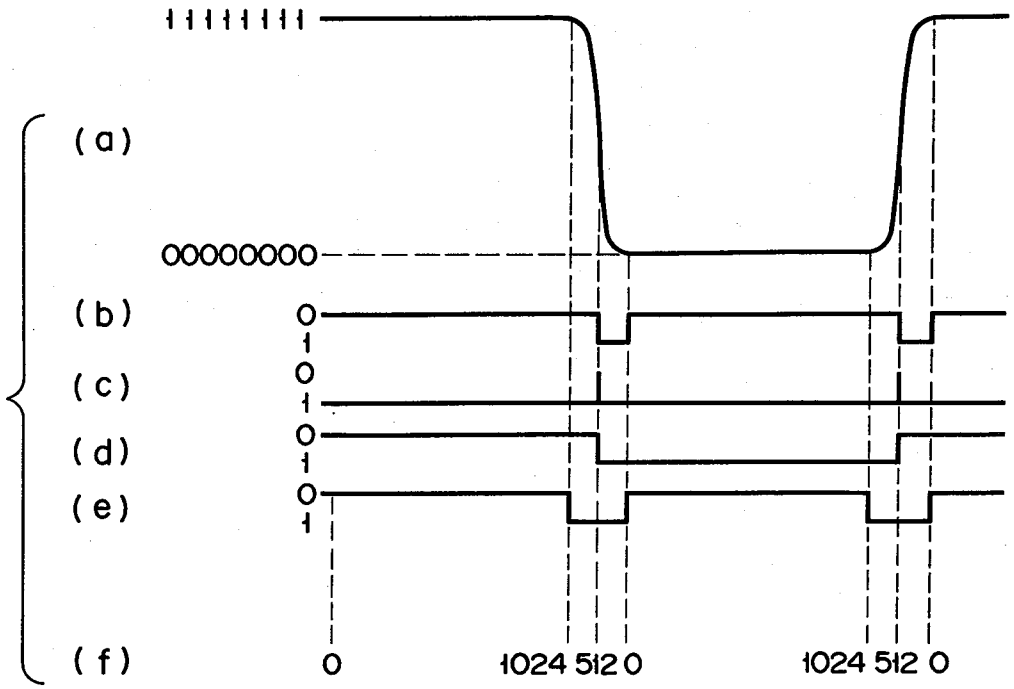
FIG. 4 is a time chart for explaining the operation of the circuit of FIGS. 2A and 2B to generate a rectangular wave.

Thus, when data of "511" or less is provided from the shift register 17 as shown in (f) in FIG. 4, the upper 7-bit data of the output is all "0" data. As a result, the output of the AND gate 22-1 fed to the exclusive OR gates 20-8 to 20-0 goes to "1". Meanwhile, 9-bit all "1" data is fed again to the other input terminals of the exclusive OR gates 20-8 to 20-0. Thus the output fed to the A input terminals of the ROM 23 is 9-bit all "0" data. It will be seen that while the result data of the cumulative subtracting operation is progressively reduced from "511" to "0" at intervals of $\alpha$, the ROM 23 is progressively address-designated by address data increasing from all "0" to all "1". The resultant read-out amplitude value data is thus progressively increased as shown in FIG. 3. The amplitude value data is fed through the exclusive OR gates 27-6 to 27-0 to the A input terminals A6 to A0 of the full-adder 30. Meanwhile, a "0" signal is fed to the A input terminal A7, and a "1" signal is fed to the carry input terminal $C_{in}$. Thus, the data provided from the full-adder 30 is equal to what is obtained by inverting the amplitude value data read out from the ROM 23. This data is fed to the digital filter 6.

While the output of the shift register 17 changes from "1,024" to "0" as shown in (f) in FIG. 4, the amplitude of the rectangular wave in (a) in FIG. 4 is interpolated by the quarter sine wave data read out from the ROM 23.

When the result of the cumulative subtracting operation becomes less than "0", a "0" signal is produced from the carry output terminal $C_{out}$ of the full-adder 15 in the next subtracting operation. As a result, the AND gates 18-15 to 18-0 are opened for a while, passing the note frequency code data $\beta$ to the B input terminals B15 to B0 of the full-adder 16. When the data fed to the A input terminals of the full-adder 16 and note frequency code data $\beta$ are added together and the result data is provided from the shift register 17, the outputs of the AND gates 22-1 and 22-2 are inverted to the "0" level as shown in (b) and (e) in FIG. 4, and become "0" from this instant on because the note frequency code data $\beta$ is greater than "1,024".

After the note frequency code data $\beta$ is set again, a cumulative subtracting operation with a step of $\alpha$ is subsequently executed, and the output of the shift register 17 is progressively reduced from $\beta$ to "1,024" with the step of $\alpha$. During this time, 8-bit all "0" data is fed to the A input terminals A7 to A0 of the full-adder 30. During this time, a "1" signal is fed to the carry input terminal $C_{in}$, so that 8-bit all "0" data is fed to the digital filter 6.

After the result of the cumulative subtracting operation becomes less than "1,024" and while it is being reduced down to "512", that is, while the result is "1,023" to "512", the output of the AND gate 22-2 is "1". Thus, during this time, the output of the full-adder 30 is equal to what is obtained by inverting amplitude value data from the ROM 23 by address-designating it with address data progressively reduced from the maximum address data (i.e., 9-bit all "1" data) toward the minimum address data (i.e., 9-bit all "0" data).

When the result of the cumulative subtracting operation reaches "512", a "1" signal is produced from the output terminal C1 of the full-adder 15. As a result, the output of the inverter 32 is inverted to "0", as shown in (d) in FIG. 4. When the result of the cumulative subtracting operation becomes "511", the output of the AND gate 22-1 is inverted to "1". Thus, as mentioned before, what is equal to the amplitude value data read out from the ROM 23 by address-designating it with address data changing from the minimum address to the maximum address, is supplied as the output of the full-adder 30 to the digital filter 6 while the result of the cumulative subtracting operation is changing from "511" to "0".

While the output of the shift register 17 is "1,024" to "0", the amplitude of the rectangular wave in (a) in FIG. 4 is interpolated by the waveform data from the ROM 23. When the result of the cumulative subtracting operation becomes less than "0", in the next cumulative subtracting operation a "0" signal is produced from the carry output terminal $C_{out}$ of the full-adder 15. Thus, the note frequency code data $\beta$ is set again in the full-adder 16, and the processing on the rectangular wave for the next cycle period is started.

In the above way, the processing for forming the rectangular wave for one period is completed. Denoting the period during which the output of the shift register 17 shown in FIG. 4 changes from "0" to "0" again (i.e., the period from the instant of setting of the note frequency code data $\beta$ for one operation cycle till the instant of setting of the data for the next operating cycle), by T' and the sampling period by $T_s$, the processing cycle period T' is expressed as $$T' = T_s \cdot \frac{\beta}{\alpha} \quad (1)$$

Denoting the sampling frequency by $f_s$, the frequency $f_0$ of the rectangular wave produced in the above way, is expressed as $$F_0 = \frac{1}{2T'} = \frac{f_s}{2} \cdot \frac{\alpha}{\beta} \quad (2)$$

Now, the operation will be described in connection with the case in which the wave generator 5 produces a PWM wave with reference to FIG. 5. In this case, a PWM wave specifying switch in the switch section 2 is turned on. As a result, the gate circuit G1 is closed, and the gate circuit G2 is opened. Further, the transfer gates 26, 33, and 34-7 to 34-0 are opened, and the transfer gates 29, 35 and 46-7 to 46-0 are closed. In this state, the PWM wave processing is started when a key on the keyboard 1 is turned on.

Figure 5:
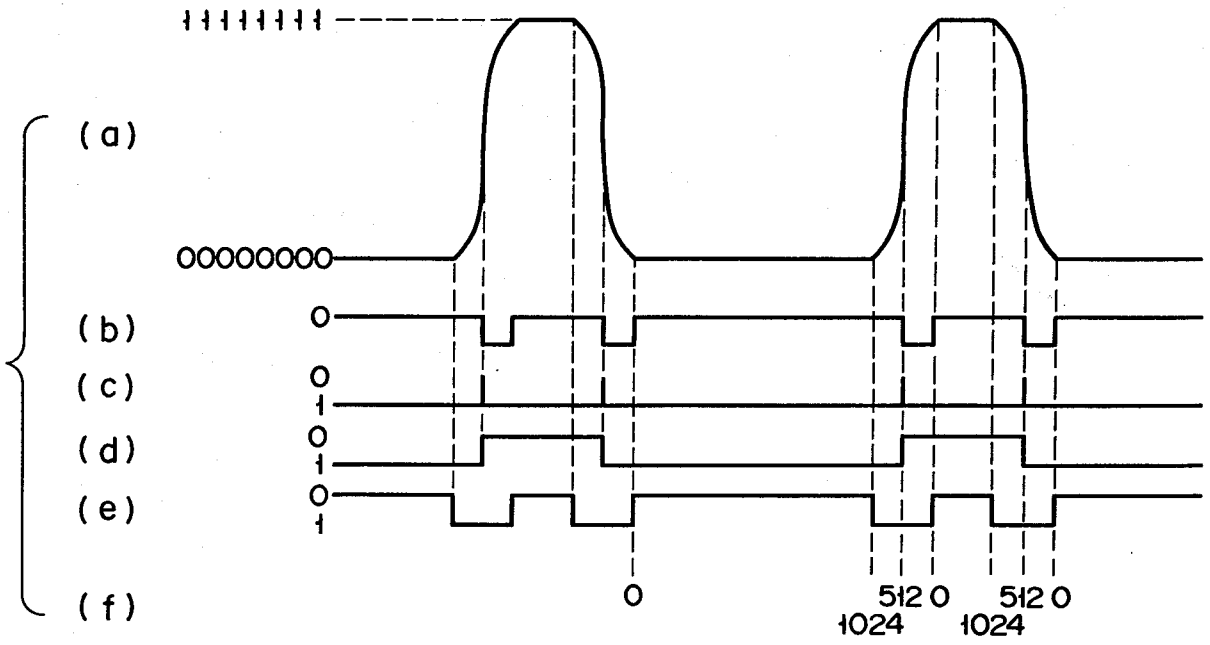
FIGS. 5 and 6 are time charts for explaining the operations of generating a PWM wave and a sawtooth wave respectively.

The operation will be described from the instant when the output of the shift register 17 shown in (f) in FIG. 5 is "0" ("0" on the left end of the Figure). At this instant, the output of the inverter 32 is "1" as shown in (d) in FIG. 5. Thus, an add command is given to the adder/subtracter circuit 43, and a "1" signal is fed to the exclusive OR gates 27-6 to 27-0, inverter 31 and carry input terminal $C_{in}$ of the full-adder 30.

Meanwhile, the subtracting circuit 41 supplies the result data $(\beta-K)$ to the multiplying circuit 42, and the multiplying circuit 42 supplys the result data $(\beta-K)\cdot\gamma$ to the adder/subtracter circuit 43. The adder/subtracter 43 supplies the result data $\beta+(\beta-K)\cdot\gamma$ to the gate circuit G2. The data K here is, for instance, "1,024", and the data $\gamma$ that determines the duty ratio is $0 \leqq \gamma \leqq 1$.

Thus, when a key as noted above is turned on, data $\beta+(\beta-K)\cdot\gamma$ is set in the full-adder 16 at the start of the processing in the manner as described before in connection with the processing for forming the rectangular wave. Now, a cumulative subtracting operation of subtracting the data $\alpha$ (of a constant value) from the data $\beta+(\beta+K)\cdot\gamma$ is executed. While the result data, i.e., the output of the shift register 17 is reduced to "1,024" through subtraction by $\alpha$ after $\alpha$, the outputs of the AND gate 22-1, inverter 50, inverter 32 and AND gate 22-2 are respectively "0", "1", "1" and "0", as shown in (b), (c), (d) and (e) in FIG. 5 respectively. Thus, during this period, the waveform read out from the ROM 23 is rendered ineffective, and the data provided from the full-adder 30 and fed to the digital filter 6 is 8-bit all "0" data.

When the result data of the cumulative subtracting operation becomes less than "1,024", the output of the AND gate 22-2 is inverted to "1". Now, while the data changes from "1,024" to "512", data obtained by inverting the amplitude value data read out from the ROM 23 with the address designation thereof, with address data progressively changing from the maximum address to the minimum address, is provided from the full-adder 30 and fed to the digital filter 6.

When the result data becomes "512", the output of the inverter 32 is inverted to "0" as shown in (d) in FIG. 5. As a result, a subtract command is given to the adder/subtracter circuit 43 so that a "0" signal is fed to the exclusive OR gates 27-6 to 27-0, inverter 31 and carry input terminal $C_{in}$ of the full-adder 30. When the result data becomes "511", the output of the AND gate 22-1 is inverted to "1", as shown in (b) in FIG. 5. Thus, while the result data changes from "511" to "0", the output of the full-adder 30 produces amplitude value data read out from the ROM 23, with address designation thereof by address data progressively changing from the minimum address to the maximum address.

After the result data becomes "0" as shown in (f) in FIG. 5, in the subsequent subtracting operation data $\beta-(\beta-K)\cdot\gamma$ is set in the full-adder 16. When the result data becomes less than "0", the outputs of the AND gates 22-1 and 22-2 are inverted to "0", as shown in (b) and (e) in FIG. 5. When the data $\beta-(\beta-K)\cdot\gamma$ is set in the full-adder 16, the cumulative subtracting operation by $\alpha$ at a time is started. While the result data is reduced to "1,024", the output of the full-adder 30 remains 8-bit all "1" data. When the result data becomes less than "1,024" as shown in (f) in FIG. 5, the output of the AND gate 22-2 is inverted to "1" as shown in (e) in FIG. 5. Thus, while the result data subsequently reduces down to "512", the full-adder 30 produces the same data as the amplitude data read out from the ROM 23, with the address designation thereof with address data changing from the maximum address to the minimum address, the data being fed to the digital filter 6.

While the result data is reducing from "512" to "0", the outputs of the AND gate 22-1 and inverter 32 are all "1". During this period, the full-adder 30 produces data obtained by inverting the amplitude data read from the minimum address to maximum address of the ROM 23 which have been designated in this order. This data is then fed to the digital filter 6.

In the above way, the processing for forming the PWM wave for one period is completed, and the sequence of events described above is repeated. The frequency $f_0$ here is the same as in the case of the rectangular wave and is given by the equation (2).

Now, the operation will be described in connection with the case in which the wave generator 5 produces a sawtooth wave with reference to FIG. 6. Here, a sawtooth wave specifying switch on the switch section 2 is turned on. As a result, the gate circuit G1 is opened, and the gate circuit G2 is closed. Also, the transfer gates 29 and 35 are opened, and the transfer gates 26 and 33 are closed. In this state, the processing for sawtooth wave formation is started when a key on the keyboard 1 is turned on.

Figure 6:
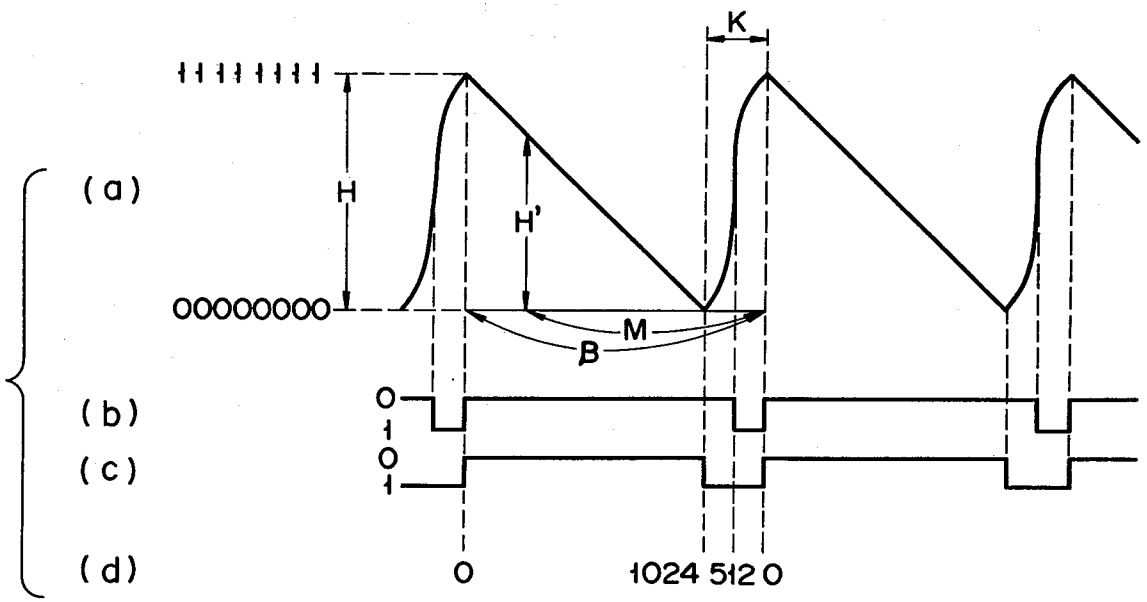

The operation will be described from the instant when the output of the shift register 17 shown in (d) in FIG. 6 is "0" ("0" on the left end of the Figure). At this instant, the note frequency code data $\beta$ is set in the full-adder 16. The note frequency code data $\beta$ is then provided from the shift register 17. Since the code data $\beta$ is greater than "1,024", the outputs of the AND gates 22-1 and 22-2 are inverted to "0" as shown in (b) and (c) in FIG. 6. Also, with the inversion of the output of the AND gates 22-1 and 22-2 to "0", the inverter 37 provides output "0", and the inverter 47 provides output "1". Thus, the transfer gates 34-7 to 34-0 are closed, while the transfer gates 46-7 to 46-0 are opened. Also, the cumulative subtracting operation of subtracting data $\beta$ (i.e., constant data) from the note frequency code data $\beta$ is started in the full-adders 15 and 16, shift register 17 and AND gates 18-15 to 18-0. Until the result data of the cumulative subtracting operation is subsequently reduced to "1,024", the output of the AND gate 22-2 is not changed. During this time, the output of the subtracting circuit 44 is passed through the transfer gates 46-7 to 46-0 which are in the open state. The output data M-K of the subtracting circuit 45 is fed to the input terminal A of the dividing circuit 44, while the output data ($\beta$−K) is fed to the input terminal B of the circuit 44. The dividing circuit 44 thus produces output data H', which is given as $$H' = \frac{M - K}{\beta - K} \times H \tag{3}$$

where M is the output of the shift register 17, K is a constant ("1,024" in this embodiment), and H is the maximum amplitude value ("256" in the present embodiment). The equation 3 thus reduces to $$H' = \frac{M - 1{,}024}{\beta - 1{,}024} \times 256 \tag{4}$$

It will be seen from equation 4 that when the output M of the shift register 17, i.e., the result data of the cumulative subtracting operation, becomes "1,024", the data fed to the digital filter 6 is "0". When the result data becomes less than "1,024", the output of the AND gate 22-2 is inverted to "1" as shown in (c) in FIG. 6. Thus, the transfer gates 34-7 to 34-0 are opened, while the transfer gates 46-7 to 46-0 are closed. Until the result data of the cumulative subtracting operation is subsequently reduced to 512", the output of the AND gate 22-1 remains "0". During this time, the "1" output of the inverter 28 is thus fed to the exclusive OR gates 27-6 to 27-0, inverter 31 and carry input terminal $C_{in}$ of the full-adder 30. While the result data is reduced from "1,023" to "512", the full-adder 30 produces data obtained by inverting the amplitude data read from the maximum to minimum addresses of the ROM 23 which have been designated in this order. The data is supplied to the digital filter 6 through the transfer gates 34-7 to 34-0.

When the result data becomes less than "512", the output of the AND gate 22-1 is inverted to "1" as shown in (b) in FIG. 6. Thus, subsequent to the appearance of this "1" signal which is fed to the exclusive OR gates 20-8 to 20-0, the ROM 23 is address-designated with address data changing from the minimum address to the maximum address, while the "0" output of the inverter 28 is fed to the exclusive OR gates 27-6 to 27-0, inverter 31 and carry input terminal $C_{in}$ of the full-adder 30. Thus, while the result data changes from "511" to "0", the amplitude data read out from the ROM 23 is directly fed to the digital filter 6. Then, the note frequency code data $\beta$ is set again in the full-adder 16.

In the above way, the processing for forming the PWM wave for one period is completed. The frequency $f_0$ here is given as $$f_0 = f_s \cdot \frac{\alpha}{\beta} \tag{5}$$

It will be seen from the equation (5) that in the case of the sawtooth wave, unlike the cases of the rectangular wave and PWM wave, it is necessary to double the note frequency code data $\beta$.

The description so far has been concerned with the case in which only a single key on the keyboard 1 is turned on in the operation of forming the rectangular wave, PWM wave and sawtooth wave. However, since the present embodiment of the music synthesizer is an 8-tone polyphonic music synthesizer, even if a plurality of keys (up to 9 keys) are simultaneously turned on, the circuits in FIGS. 1 and 2 can operate on a time division basis for eight channels to produce the basic waves for the individual keys simultaneously, but the details in this connection are not given.

Figure 7:
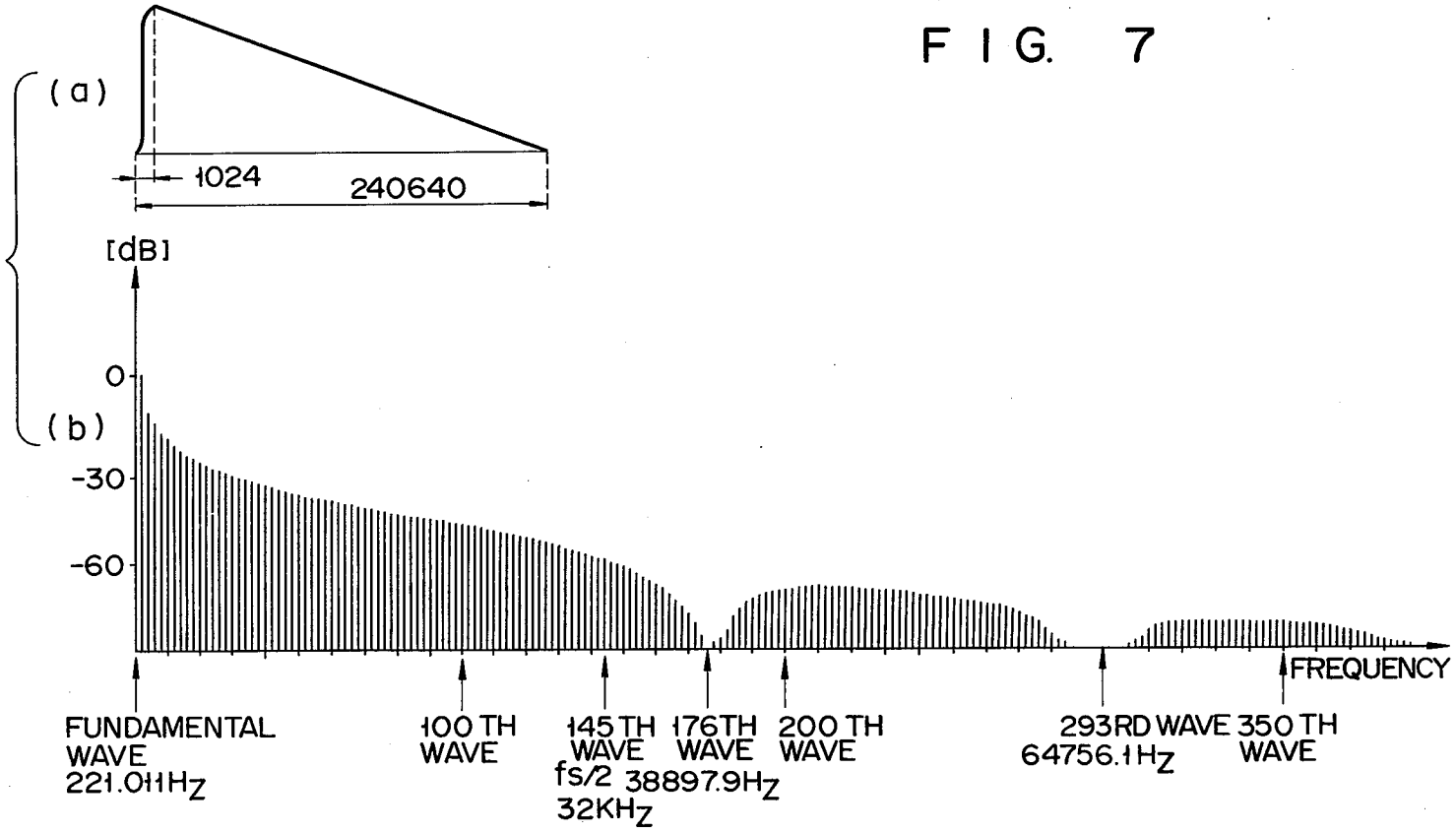
FIGS. 7, 8 and 9 are diagrams showing harmonic structures of sawtooth waves of different frequencies.
Figure 8:
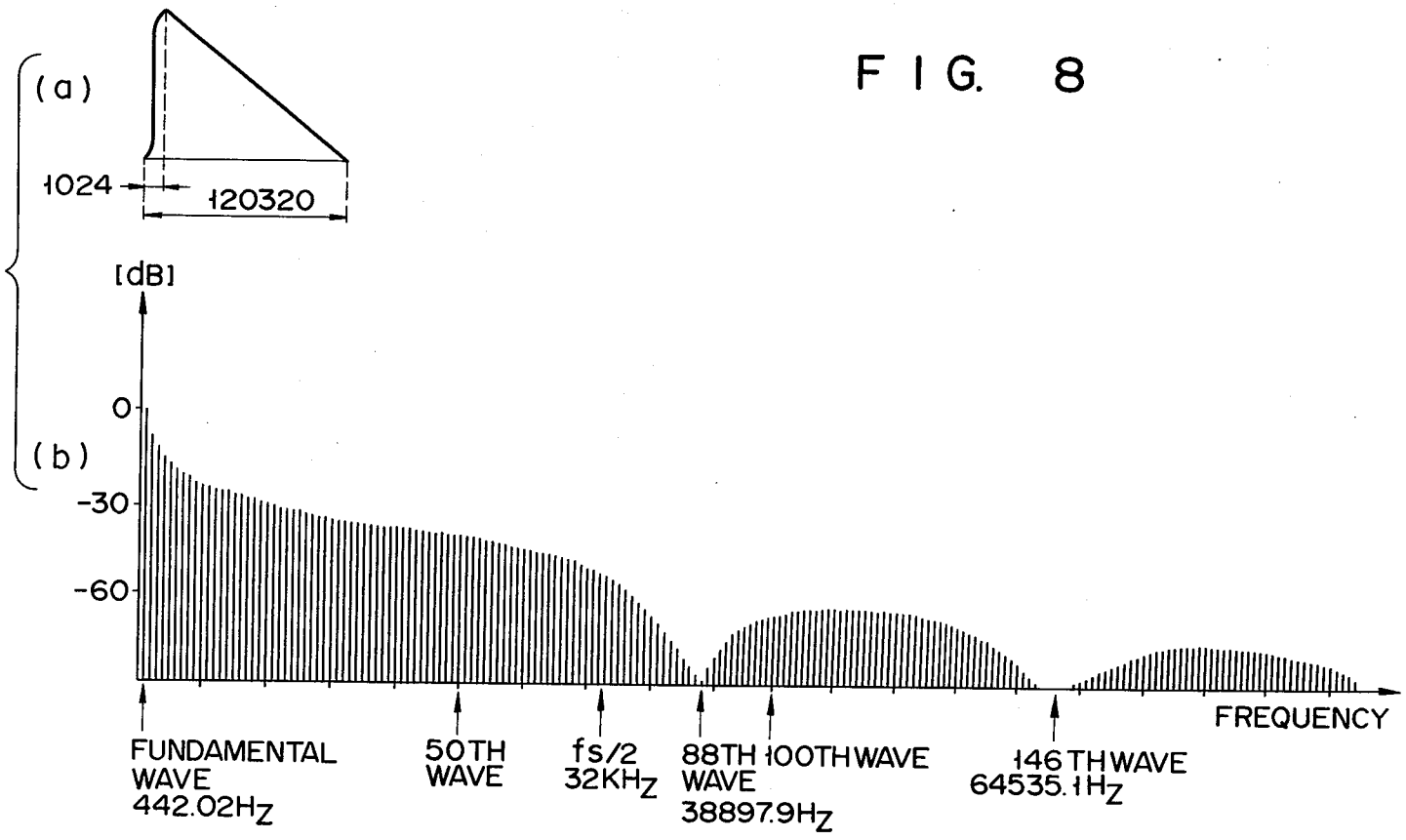
Figure 9:
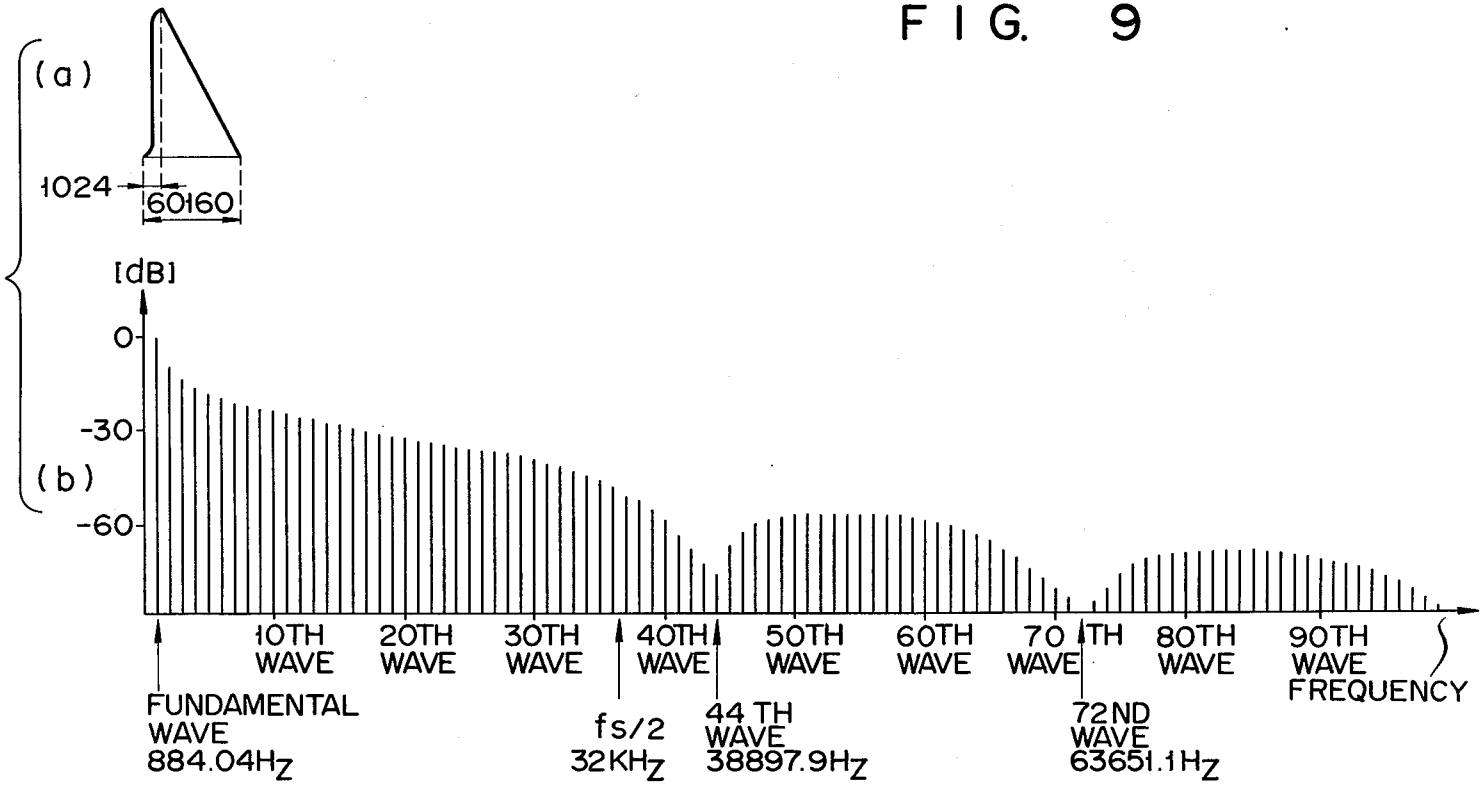

FIGS. 7 to 9 show experimental data of the harmonic structure of saw-tooth waves formed for three different frequencies with the above embodiment. In either of these waves, the sampling frequency $f_s$ is 64 kHz.

In the sawtooth wave of FIG. 7, the base tone frequency is 221.011 Hz, which is obtained by substituting $\alpha=831$, $\beta=240{,}640$ and $f_s=64$ kHz, as shown in (a) in to the equation (5). As is seen in (b) in FIG. 7, the folding distortion due to the sampling theory occurs at a frequency of $f_s/2=32$ kHz, which corresponds to the 145-th harmonic. The base tone and harmonic tone components up to the 144-th harmonic all have levels higher than those of the 145-th and higher harmonics and are satisfactory. There are dips where no harmonic is produced in the neighborhood of the 176-th harmonic and in the neighborhood of the 293-rd harmonic.

FIG. 8 shows the harmonic structure of a sawtooth wave for a different base tone frequency. Here, the base tone frequency is 442.02 Hz, which is obtained by substituting $\alpha=831$, $\beta=120{,}320$ and $f_s=64$ kHz, as shown in (a), into the equation 5. As is seen in (b), the frequency at which the folding distortion occurs corresponds to the 73-rd harmonic. The base tone and harmonic tone components up to the 72-nd harmonic all have levels higher than those of the 145-th and higher harmonics. There are two dips in the neighborhood of the 88-th harmonic and in the neighborhood of the 146-th harmonic.

FIG. 9 shows the harmonic structure of a sawtooth wave for a base tone frequency different from those in the cases of FIGS. 7 and 8. Here, the base tone frequency is 884.04 Hz, which is obtained by substituting $\alpha=831$, $\beta=60{,}160$ and $f_s=64$ kHz, as shown in (a), into the equation (5). As shown in (b), the frequency of the 37-th harmonic substantially corresponds to 32 kHz. In this case, the base tone and harmonic tone components up to the 36-th harmonic all have levels higher than those of the 37-th and higher harmonics. There are dips at the 44-th and 72-nd harmonics.

While FIGS. 7 to 9 show sawtooth waves for three different base tone frequencies harmonically related to one another, in any of these cases the period during which interpolation by the ROM 23 is done (i.e., processing period) is set to a constant value of "1,024". Thus, the harmonic structure (spectrum) has a fixed character for the different base tone frequencies; the two frequencies at which the dips occur are substantially fixed (i.e., in the neighborhood of 38,897.9 Hz and in the neighborhood of 64.5 kHz) for the different base tone frequencies. This applies to other frequencies than the above base tone frequencies.

Figure 10:
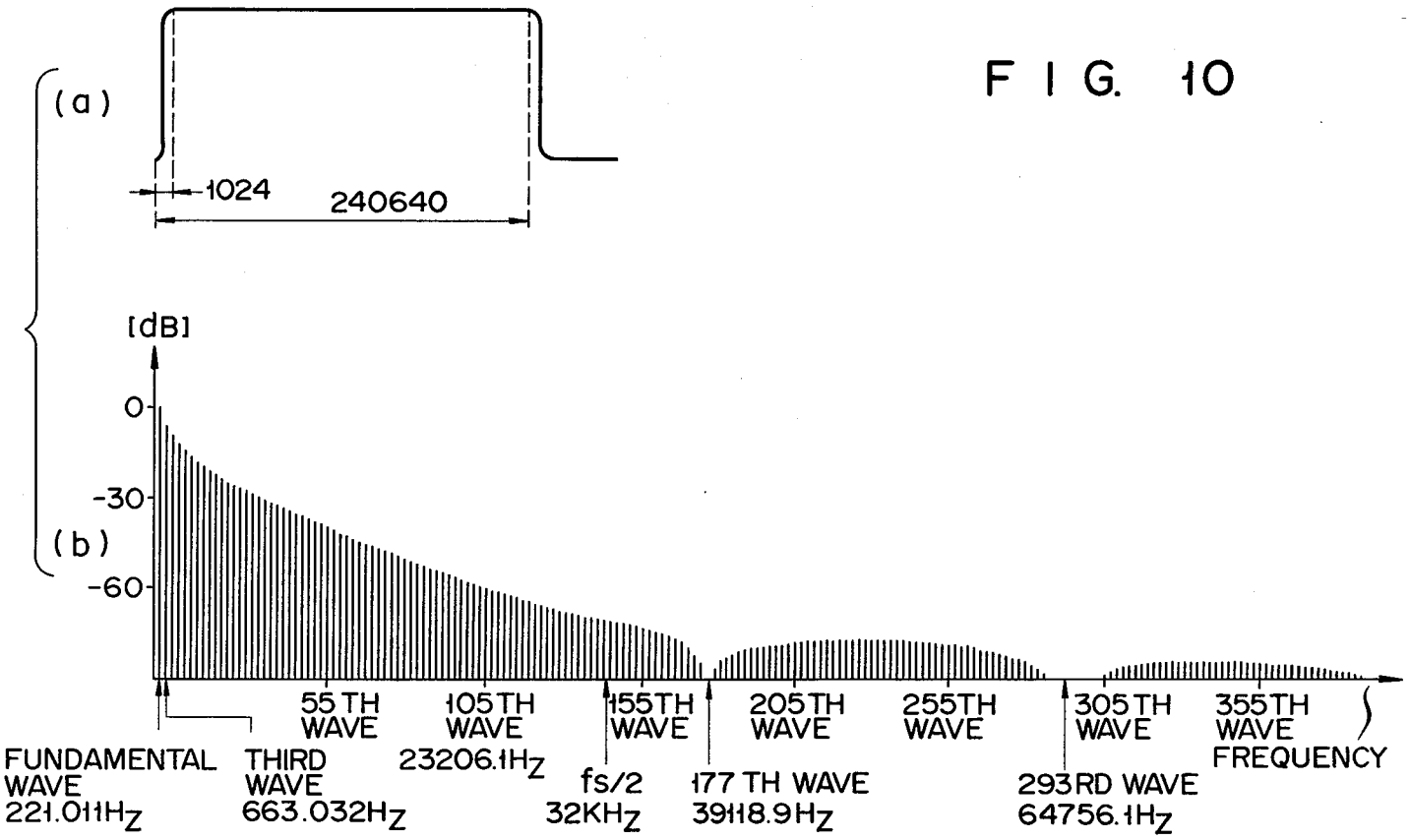
FIGS. 10, 11 and 12 are diagrams showing harmonic structures of rectangular waves of different frequencies.
Figure 11:
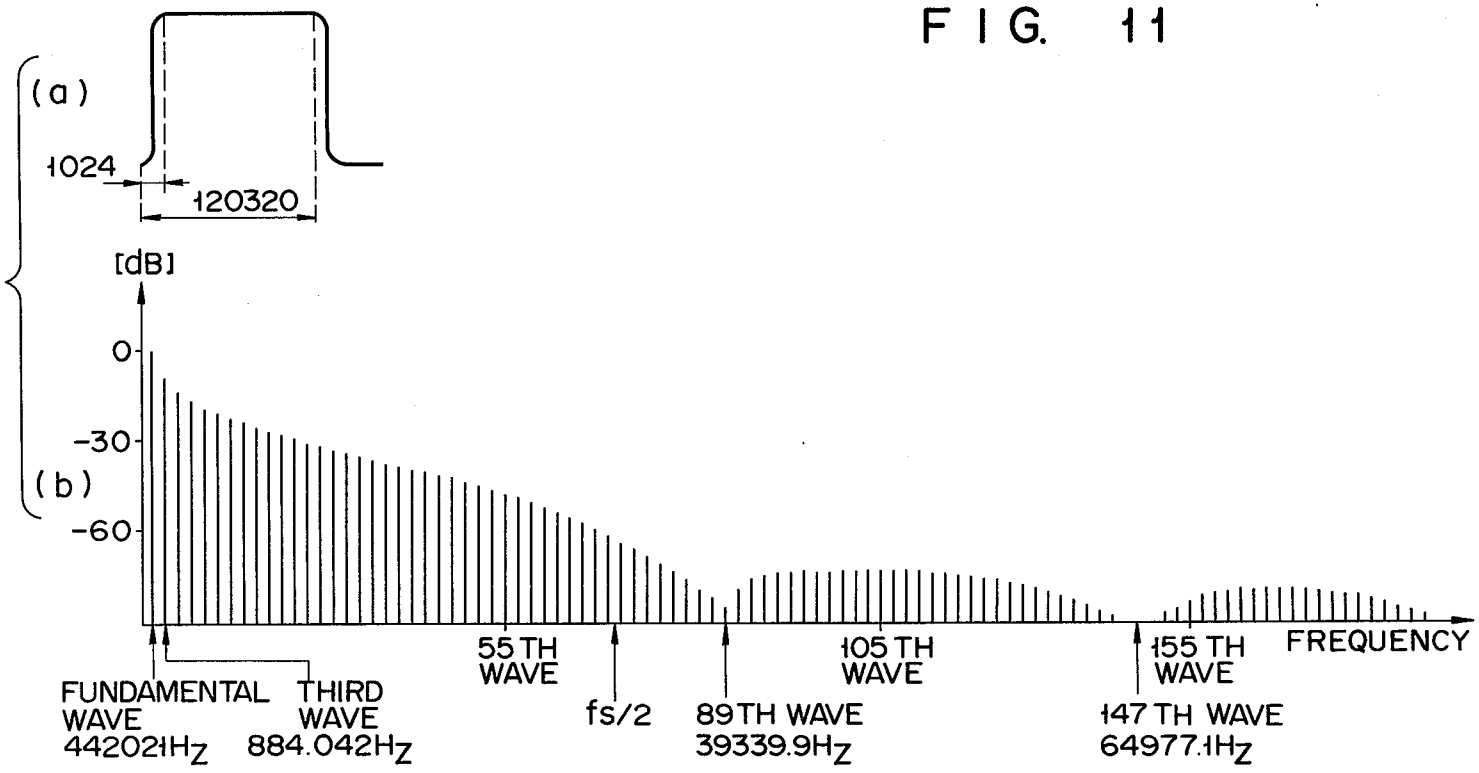
Figure 12:
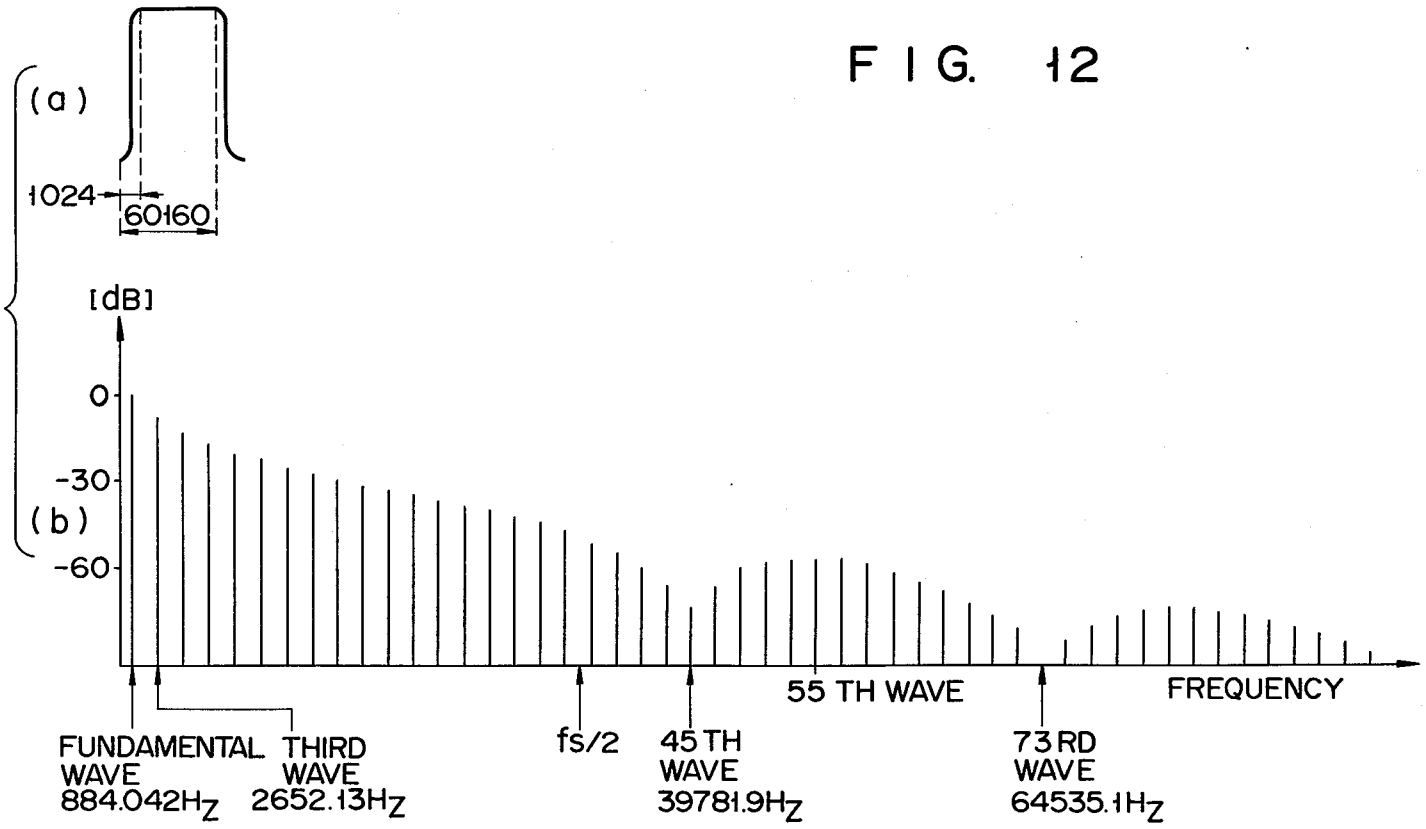

FIGS. 10 to 12 show the harmonic structure of rectangular waves formed for the aforementioned three different frequencies, i.e., 221.011 Hz, 442.021 Hz and 884.042 Hz, of the sawtooth waves described above. In these cases, therefore $\alpha=831$, $\beta=240{,}640$ or $\beta=120{,}320$ or $\beta=\mathbf{60{,}160}$, $f_s=64$ kHz, and the processing period for the interpolation is "1,024". It will be seen from the Figures that the rectangular waves have entirely the same character as the sawtooth waves described above. PWM waves again have the same character as the rectangular waves.

It is to be appreciated that by setting a fixed interpolation period (i.e., processing period) independent of the note frequency, waves which are bandwidth restricted at a fixed frequency can be easily obtained for all note frequencies.

Figure 13:
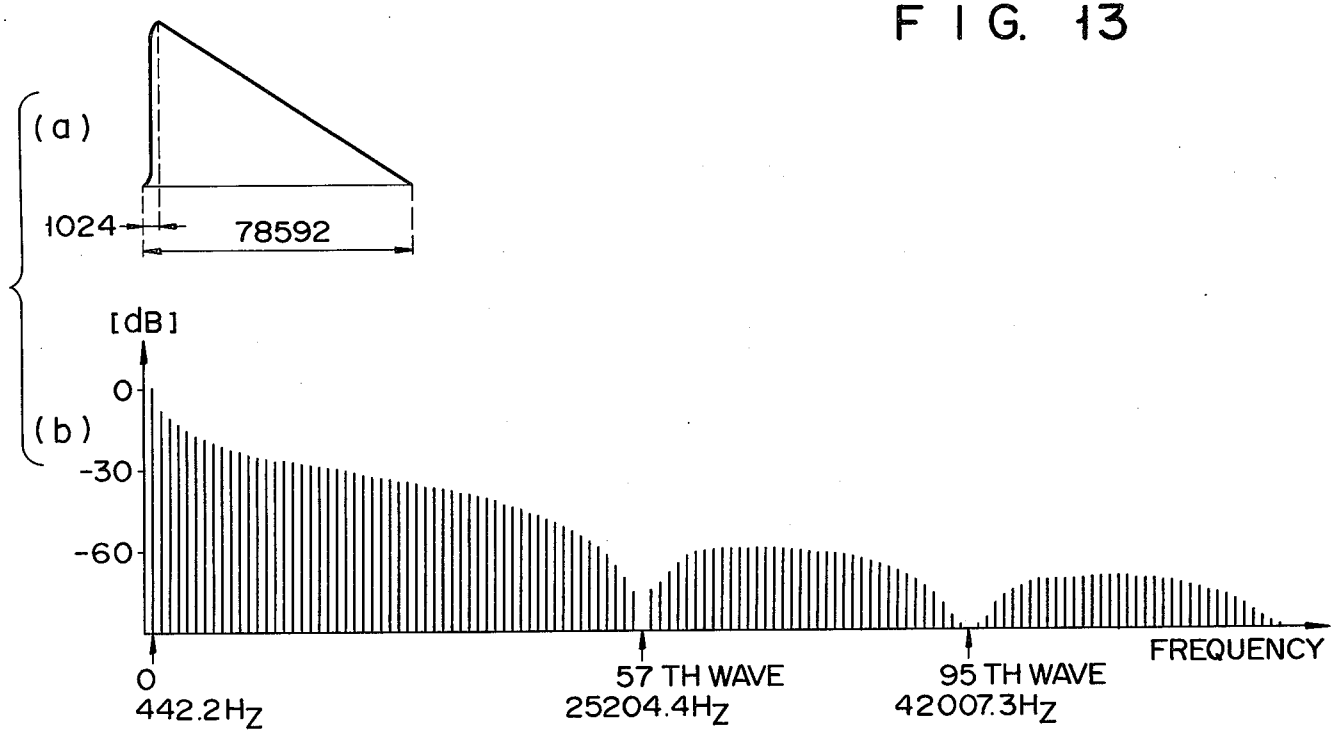
FIGS. 13 and 14 are diagrams showing harmonic structures of sawtooth waves of the same frequency but with different processing periods for interpolating portions.
Figure 14:
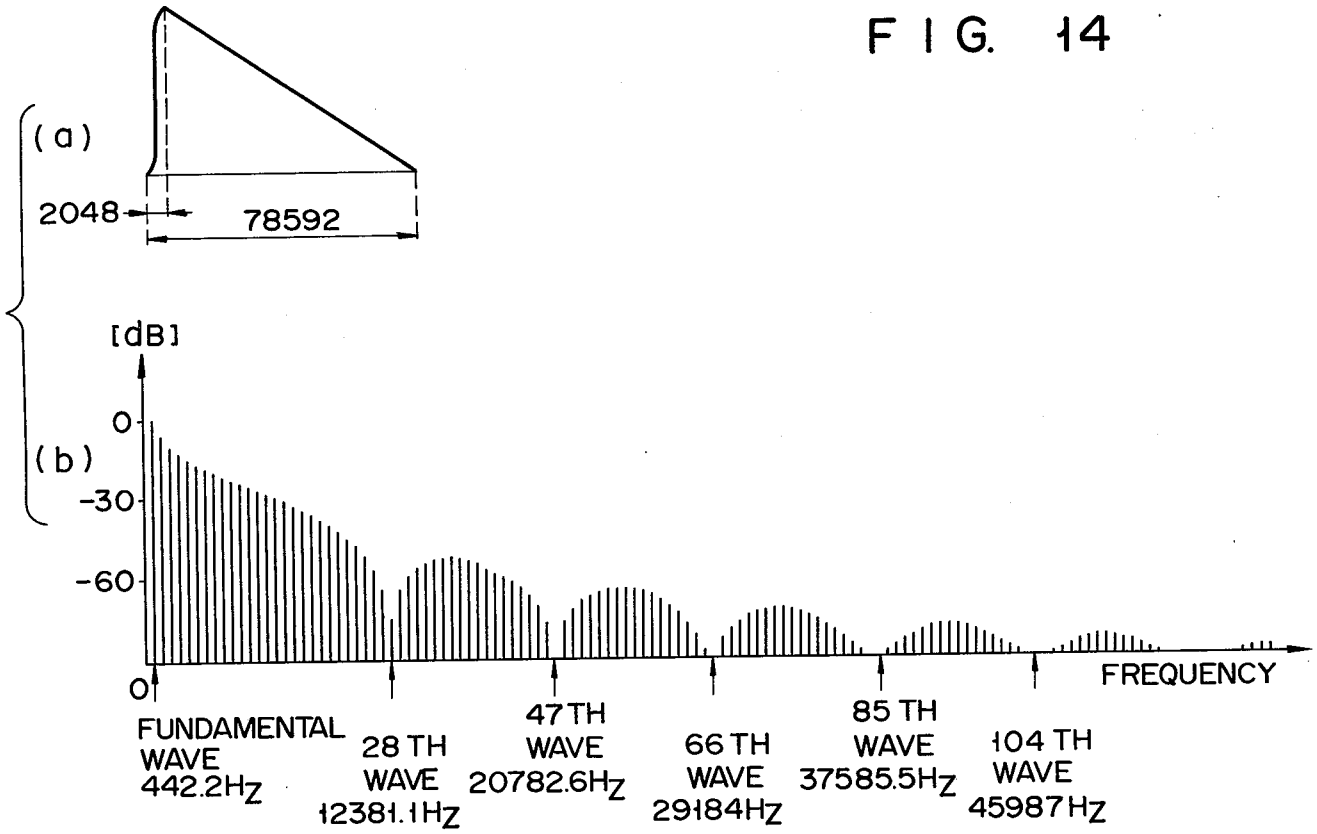

FIGS. 13 and 14 show the harmonic structure of two different sawtooth waves, which are for the same base tone frequency but for different interpolation processing periods. In the case of FIG. 13, the base tone frequency is 442.2 Hz which is obtained by substituting $\alpha=543$, $\beta=78{,}592$ and $f_s=64$ kHz, as shown in (a), into the equation 5, and the interpolation processing period is set to "1,024". In the case of FIG. 14, $\alpha$, $\beta$ and $f_s$ are the same as those in the case of FIG. 13, as shown in (a), while the interpolation processing period is set to "2,048". It will be seen that these waves can be realized by varying the value of the data K provided from the CPU 3. It will be seen from the comparison of (b) in FIG. 13 and (b) in FIG. 14 that the like harmonic components in these waves have different levels. This means that filter effects for different tone colors can be obtained for a tone of the same tone frequency by merely varying the interpolating processing period. Further, it will be seen from the comparison of FIGS. 8 and 13 showing the harmonic structure of sawtooth waves at the base tone frequency of 442 Hz that with the same sampling frequency $f_s$ and same interpolation processing period, the harmonic structure can be varied by varying the values of $\alpha$ and $\beta$ to be set.

While in the above description of the embodiment three different kinds of basic waves, i.e., rectangular waves, PWM waves and sawtooth waves have been treated, the basic wave may be of other kinds, such as triangular waves and inclined waves. Further, the sine wave used for the interpolation of the regions where there are sharp changes in the amplitude level of the basic wave, may be replaced with other curves such as those of second-order functions, third-order functions, exponential functions, other triangular functions, etc. Also, the quarter sine wave stored in the ROM 23 may be replaced with a full sine wave or half sine wave. Further, although in the above embodiment the cumulative subtracting operation of progressively subtracting a constant value $\beta$ from an initial value $\alpha$ set in the full-adder has been performed, it is also possible to obtain the basic waves as in the above embodiment through a cumulative adding operation of progressively adding a constant value to an initial value $\beta$. Moreover, the processing circuit for determining the note of the basic wave can be variously modified. Further, the invention may be applied not only to music synthesizers but also to various other electronic musical instruments, and also various further changes and modifications of the above embodiment are possible without departing from the scope of the invention.

With the above embodiment of the invention is applied to an electronic musical instrument, which uses a wave generator which can form various basic waves such as rectangular waves through data processing using a digital circuit, there is no need to use any ROM where waves are stored. Thus, it is possible to provide basic waves containing sufficient harmonic components even for low frequencies without the need of any vast hardware structure. Besides, a polyphonic electronic musical instrument can be readily realized by making use of time division basis processing in the digital circuit. Particularly, the folding distortion due to the sampling theory can be readily reduced by using a curve of a second-order function for the interpolation of a portion of the wave to be formed where there is a sharp change in the amplitude level of the basic wave. In this case, by setting a fixed interval of the interpolation portion (i.e., processing period) irrespective of the note frequency, waves which are bandwidth-restricted at a fixed frequency can be obtained for all note frequencies. Also, a variable filter effect can be readily obtained by making the interval of the interpolation portion variable.

In the above embodiment of FIG. 1, the data $\alpha$ provided from the CPU 3 has been a fixed data. If data which can be varied periodically is used as the data $\alpha$, it is possible to provide vibrato of the same depth and same speed to all musical notes. Also, it is possible to obtain frequency control through variation of the data $\alpha$.

Figure 15:
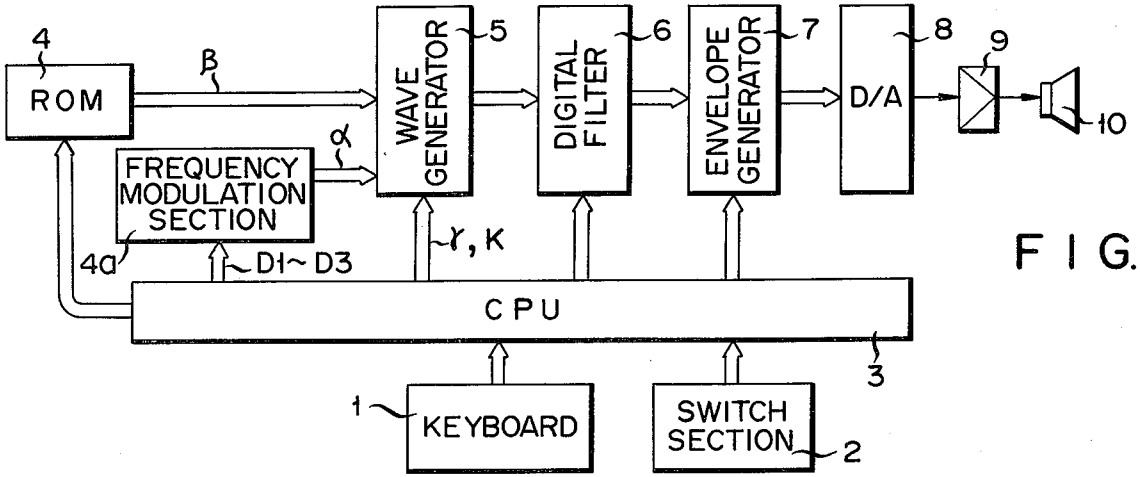
FIG. 15 is a system block diagram showing a different embodiment of the invention.
Figure 16:
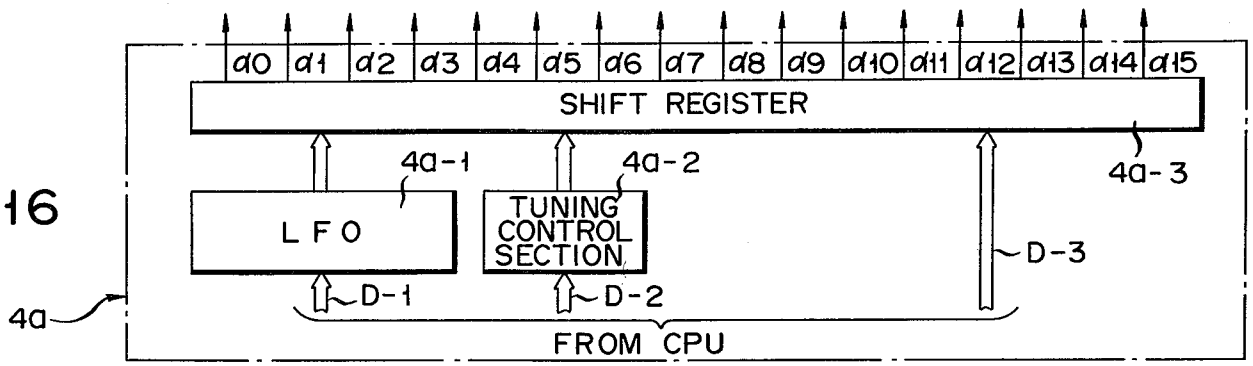
FIG. 16 is a block diagram showing a frequency modulation section in FIG. 15.

FIG. 15 shows a different embodiment, in which the data $\alpha$ is variable. Control signals D-1 to D-3 are provided from the CPU 3 to a frequency modulation section 4*a*. The frequency modulation section 4*a* supplys frequency modulated data $\alpha$ to wave generator 5. FIG. 16 shows the frequency modulation section 4*a* in detail. This embodiment of FIG. 15 is the same as the previous embodiment of FIG. 1 except that the frequency modulation section 4*a* is provided.

The frequency modulation section 4a includes a low frequency oscillator (LFO) 4a-1, a tuning control section 4a-2 and a shift register 4a-3. The control data D-1 and D-2 are supplied to the LFO 4a-1 and tuning control section 4a-2 respectively. The LFO 4a-1 produces a low frequency signal for either a triangular, sawtooth or rectangular wave under the control of the input control data D-1, the low frequency signal produced being supplied to the shift register 4a-3. The LFO 4a-1 will now be described later in detail with reference to FIGS. 17 and 18.

The tuning control section 4a-2 effects tuning control according to the input control data D-2. Its output data is supplied to the shift register 4a-3. The shift register 4a-3 supplies data received from the LFO 4a-1 and tuning control section 4a-2 as the aforementioned data, α to the B input terminals of the full-adder 15 (see FIGS. 2A and 2B) when providing vibrato or when executing tuning. At a time other than when providing vibrato or executing tuning, data D-3 is supplied from the CPU 3 to the shift register 4a-3. The shift register 4a-3 supplies the data D-3 as the data α to the B input terminals of the full-adder 15. In a case there the music synthesizer is an 8-tone polyphonic music synthesizer, the shift register 4a-3 consists of 16-bit shift registers connected in cascade.

Figure 17:
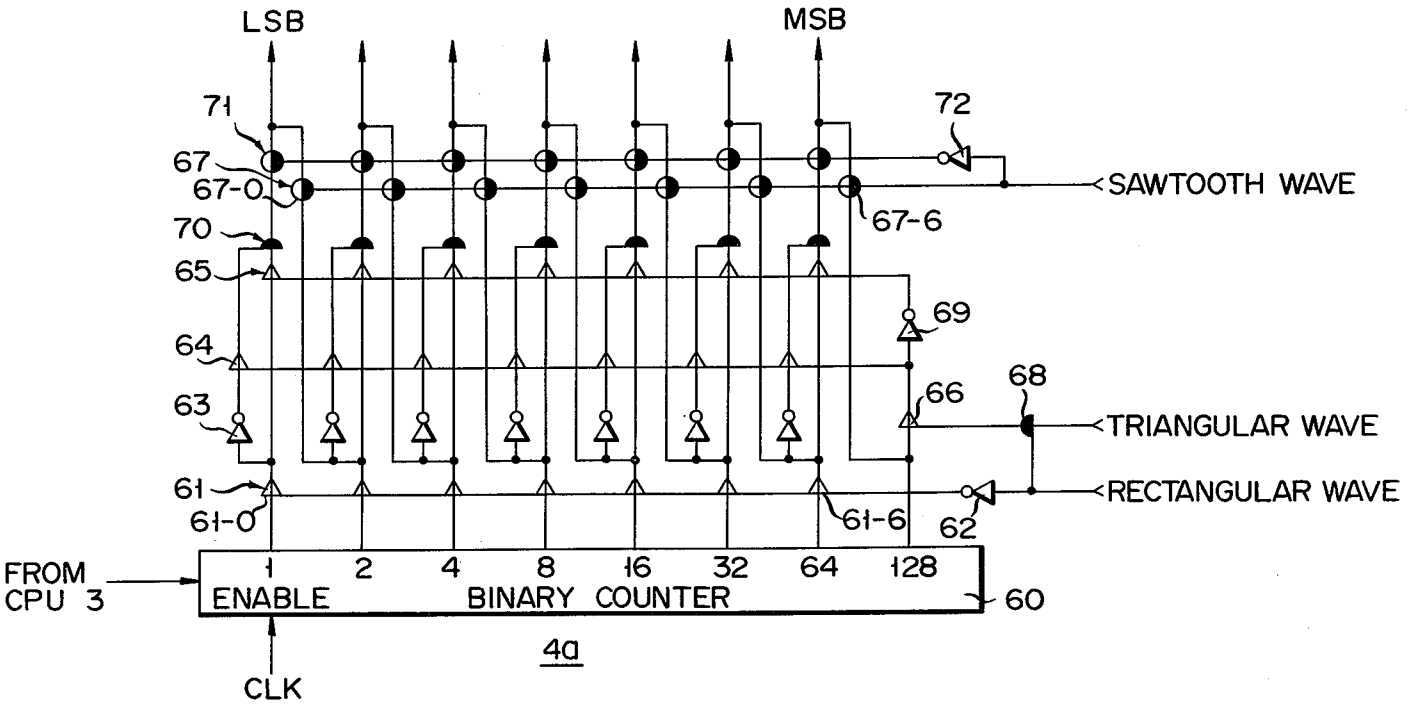
FIG. 17 is a circuit diagram showing a low frequency oscillator in FIG. 16.

The LFO 4a-1 will now be described in detail with reference to FIGS. 17 and 18. Referring to FIG. 17, a binary counter 60 is enabled to count a clock CLK when, and only when, a control data is supplied from the CPU 3 to its input terminal ENABLE (i.e., when providing vibrato). Count data which are provided from bit output terminals 1, 2, 4, 8, 16, 32 and 64 of the binary counter 60, are fed to corresponding AND gates 61-0 to 61-6 in an AND gate group 61. The gating of the AND gate group 61 is controlled by a control signal fed from an inverter 62 inverting a rectangular wave formation command. The outputs of the AND gates in the AND gate group 61 are coupled through respective inverters 63 to corresponding AND gates in an AND gate group 64. Also, these outputs are directly fed to corresponding AND gates in an AND gate group 65.

The output from the most significant bit (MSB) output terminal 128 of the binary counter 60 is also fed to an AND gate 66 and also to a transfer gate 67-6 in a transfer gate group 67. The AND gate 66 is controlled for gating by the output of an OR gate 68, to which the rectangular wave formation command noted above and a triangular wave formation command are supplied. The output of the AND gate 66 is used as a gating control signal for the AND gate group 64. A signal from an inverter 69, which inverts the output of the AND gate 66, is used as a gating control signal for an AND gate group 65. The outputs of the AND gate groups 64 and 65 are coupled through an OR gate group 70 to a transfer gate group 71. The transfer gate group 67 is directly controlled for gating by a sawtooth wave formation command, while the transfer gate group 71 is controlled for gating by a signal from an inverter 72 which inverts the sawtooth wave formation command. The output of the transfer gate group 67 or 71 (which is 7-bit data) serves as data for providing the amplitude level of a triangular wave, a sawtooth wave and a rectangular wave as shown respectively in (b), (c) and (d) in FIG. 18; that is, triangular, sawtooth and rectangular wave low frequency signals are produced according to this data. A vibrato effect is provided by these low frequency signals. The data provided from the LFO 4a-1 in the frequency modulation section 4a is fed as lower bit data of the data α. The data α here is varied at low frequencies in accordance with the operation of the LFO 4a-1 which will be described later. More particularly, the binary counter 60 in FIG. 17 counts the clock signal CLK with the control data from the CPU 3 fed to its input terminal ENABLE. The count data changes from "0" to "256" in one period.

When the triangular wave formation command is present (i.e., at "1") due to the operation of a corresponding switch in the switch section 2, the output of the OR gate 68 is "1", and the AND gate 66 is in the enabled state. When the sawtooth wave formation command and rectangular wave formation command are both "0", the output of the inverter 62 is "1". Thus, the AND gate group 61 is in the enabled state, the transfer gate group 67 is in the disabled state, and the transfer gate group 71 is in the enabled state.

Thus, during the period, duriag which the bit output terminal 128 of the binary counter 60 is "0", i.e., for the first half of one period (during which the count data changes from "0" to "128"), the output of the AND gate 66 is "0". During this period, the AND group 64 is in the disabled state, while the AND gate group 65 is in the enabled state. Thus, for the first half of one period, the count data from the bit output terminals 64 to 1 of the binary counter 60 (which is 7-bit data) is coupled through the AND gate groups 61 and 65, OR gate group 70 and transfer gate group 71. The output data is thus the same as the count data of the binary counter 60 and is increased by "1" after "1".

For the subsequent period, during which the bit output terminal 128 of the binary counter 60 is "1", i.e., for the second half of one period (during which the count data changes from "128" to "256"), the AND gate 66 provides a "1" output. Thus, for the second half of one period, the AND gate group 64 is in the enabled state, while the AND gate group 65 is in the disabled state. During this period, the data from all the bit output terminals 64 to 1 of the binary counter 60 is coupled through the AND gate group 61, inverter group 63, AND group 64, OR gate group 70 and switching gate group 71. The output data is thus reduced by "1" after "1".

Figure 18:
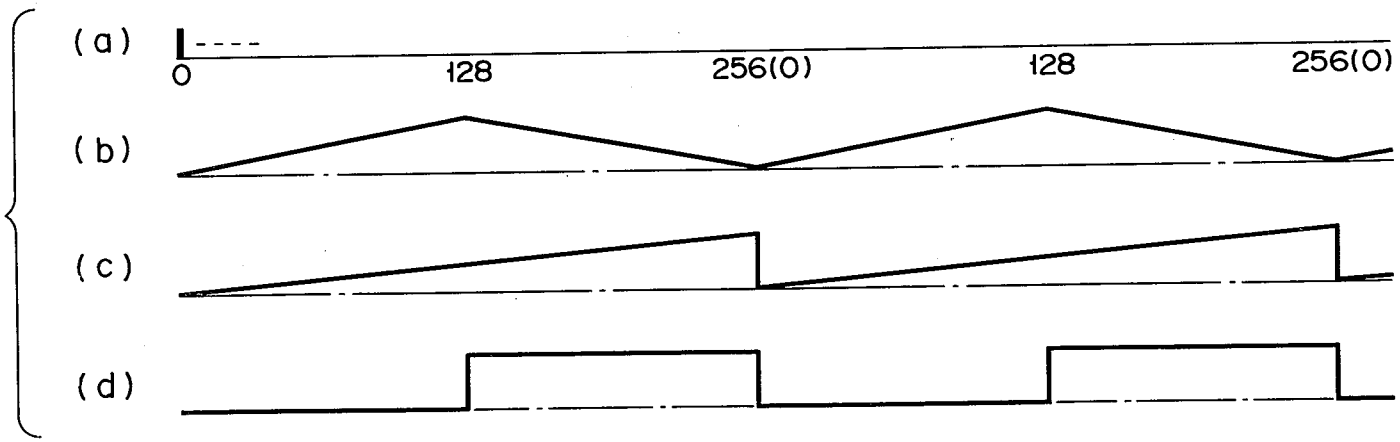
FIG. 18 is a waveform chart showing output waveforms of the low frequency oscillator of FIG. 17.

In the above way, a triangular wave low frequency signal as shown in (b) in FIG. 18 is obtained, which is used for providing a vibrato effect.

When only the sawtooth wave formation command is present, only the transfer gate group 67 is in the enabled state, while the transfer gate group 71 is in the disabled state. Further, the AND gate group 61 is in the enabled state, and the AND gate 66 is in the disabled state. Thus, the AND gate group 64 is in the disabled state, and the AND gate group 65 is in the enabled state.

For the first half of one period (i.e., while the count data changes from "0" to "128"), the count data from the bit output terminals 128 to 1 of the binary counter 60 is coupled through the AND gate group 61 and transfer gate group 67. The output data thus increases by "1" after "1" from "0" to "128" with one half the slope of the triangular wave.

For the second half of one period (i.e., while the count data changes from "128" to "256"), the output of the most significant bit output terminal 128 of the binary counter 60 is "1". The output data thus increases by "1" after "1" from "128" to "256" with the same slope as in the previous increase from "0" to "128".

In the above way, a triangular wave low frequency signal as shown in (c) in FIG. 18 is obtained.

When only the rectangular wave formation command is present, the AND gate group 61 is held disabled by a "0" output of the inverter 62, and the AND gate 66 is held enabled. Thus, for the first half of one period (during which the count data changes from "0" to "128"), the bit output terminal 128 is "0", and the output of the AND gate 66 is also "0". Thus, the AND gate group 64 is held disabled, and the AND gate group 65 is held enabled. Since the AND gate group 61 is held disabled, the outputs of the AND gates in the AND gate group 65 are all "0", and the outputs of the AND gates in the AND gate group 64 are also all "0". Thus, for the first half of one period the output data is all "0" data.

For the second half of one period (during which the count data changes from "128" to "256"), the output of the bit output terminal 128 is "1" so that the output of the AND gate 66 is "1". Thus, the AND gate group 64 is held enabled, and the AND gate group 65 is held disabled. The output of the AND gate group 61, which is all "0" data, is inverted through the inverter group 63 into all "1" data, which is coupled through the AND gate group 64, OR gate group 70 and switching gate group 71. Thus, for the second half of one period, the output data is held at "127" (all "1"). Consequently, a rectangular wave low frequency signal as shown in (d) in FIG. 18 can be obtained.

Since the LFO 4a-1 operates in the above way, as the value of the data $\alpha$ changes at low frequencies the frequency $f_0$ of the rectangular wave changes according to the change in the data $\alpha$ as is obvious from the equation 2. Thus, it is possible to provide a vibrato effect to the tone produced.

The operation of tuning with respect to a tone based on the above rectangular wave will now be described. In this case, data provided from the tuning control section 4a-1 in the frequency modulation section 4a is fed as the lower bit data of the data $\alpha$ to the B input terminals of the full-adder 15. The tuning control section 4a-2 adds a constant value to or subtracts in from the proper value of the data. Mathematically, $$f_0 = a \text{ (Hz)} \tag{6}$$

and $$f_0' = a(\text{Hz}) \cdot 2^{\frac{n(cent)}{1,2000}} \tag{7}$$

where $f_0$ is the frequency when the tuning is not done, and $f_0'$ is the frequency when n (cent) tuning is done.

From the equation 2, the equations 6 and 7 can be re-written as $$f_0 = \frac{f_s \cdot \alpha}{\beta} \tag{8}$$

and $$f_0' = \frac{f_s(\alpha \pm C)}{\beta} \tag{9}$$

From the equations 6 to 9, the value of n is $$n = \frac{1,200}{\log 2} \times \log \frac{\alpha \pm C}{\alpha} \tag{10}$$

It will be appreciated that by operating a given switch the frequency $f_0$ of the produced tone can be changed by n (cent) according to the equation 10, so that tuning can be readily obtained.

Figure 19:
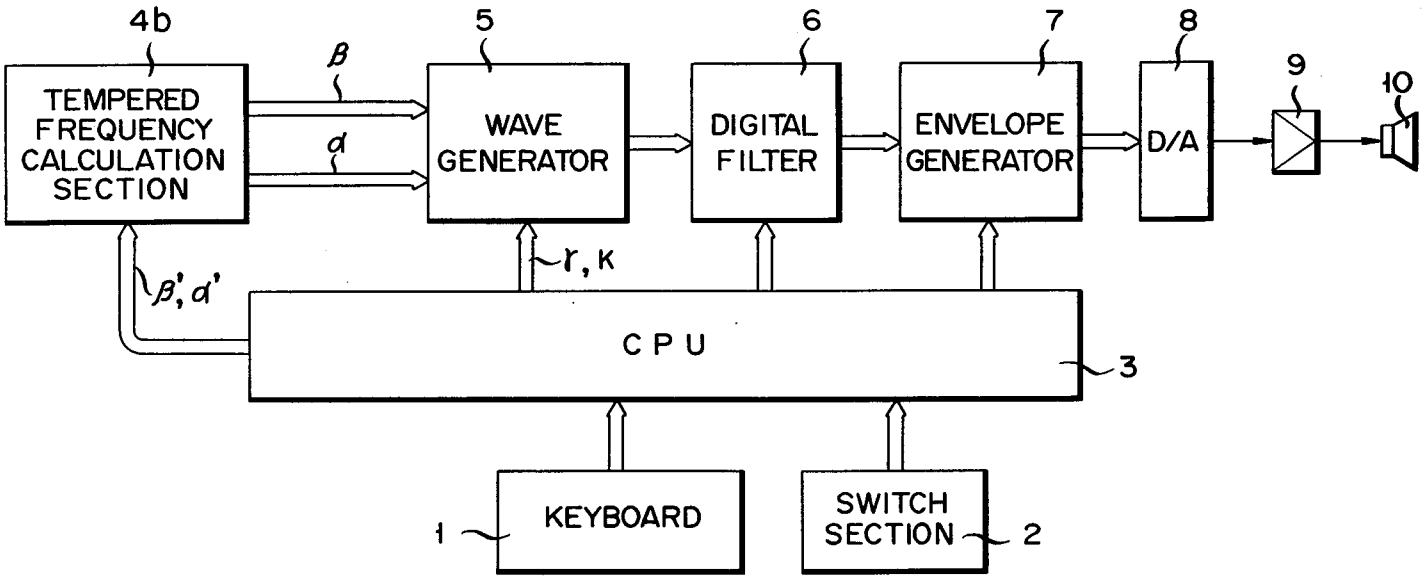
FIG. 19 is a system block diagram showing a further embodiment of the invention.

FIG. 19 is a block diagram showing a different embodiment of the invention, which can provide vibrato. Here, frequency modulation code data $\alpha'$ and note frequency code data $\beta'$, provided from the CPU 3, are fed to an average factor frequency arithmetic section 4b. The average factor frequency arithmetic section 4b is a circuit, which always supplies the frequency code data $\beta$ and $\alpha$ according to the average factor, to the wave generator 5 irrespective of the frequency modulation.

Now, various examples of the construction of the average factor frequency arithmetic section 4b will be given with reference to FIGS. 20 to 26. FIG. 20 shows a first example of the section 4b. Here, the note frequency code data $\beta'$ and frequency modulation code data $\alpha'$ both consist of N bits. Of the N-bit data, the lower n bits designate a pitch lower than a semitone, the upper 4 bits designate the note, and the remaining upper N−n−4 bits designate the octave. The 4-bit data designating the note is expressed as a duodecimal code, and other data are expressed as binary codes.

The (N−n−4)-bit data designating the note frequency code data $\beta'$ and frequency modulation code data $\alpha'$ are both fed to a binary adder/subtracter 81. The 4-bit data designating the note are both fed to a duodecimal adder/subtracter 82, and the lower n-bit data designating the pitch lower than a semitone are fed to a binary adder/subtracter 83. The binary adder/subtracter 81, duodecimal adder/subtracter 82 and binary adder/subtracter 83 execute addition or subtraction of their input data according to an add/subtract command (−) supplied from the CPU 3. The carry output of the binary adder/subtracter 83 is provided from a terminal C0 thereof and fed to a terminal $C_{in}$ of the duodecimal adder/subtracter 82. The carry output of the duodecimal adder/subtracter 82 is provided from a terminal C0 thereof and fed to a terminal $C_{in}$ in the binary adder/subtracter 81. The result data of the binary adder/subtracter 81 and duodecimal adder/subtracter 812 are fed as address data to a ROM 84. The result data of the binary adder/subtracter 83 is fed as address data to a ROM 85. In the ROM 84 note frequency code data $\beta$ according to the average factor is stored, and in the ROM 85 frequency modulation code data $\alpha$ for a semitone (for 100 cent) according to the average factor is stored as exponential function data. The note frequency code data $\beta$ and frequency modulation code data $\alpha$ read out from the ROMs 84 and 85 are both fed to the wave generator 5.

FIG. 21 shows an example in which the 4-bit note designation data which is expressed as a duodecimal code in the example of FIG. 20 is expressed as binary data. In this case, the note frequency code data $\beta'$, frequency modulation code data $\alpha'$ and add/substract command (−) are supplied to a single binary adder/subtracter 86. Of the result data of the average factor frequency processing carried out in the binary adder/subtracter 86, the upper (N−n)-bit data is fed as address data to a ROM 87, while the lower n-bit data is also fed as address data to a ROM 88. The ROM 87 has the same function as the ROM 84, and the ROM 88 has the same function as the ROM 85. The note frequency code data $\beta$ is read out from the ROM 84, and the frequency modulation code data $\alpha$ is read out from the ROM 88.

FIG. 22 shows an example in which the ROM 88 in the example of FIG. 21 is replaced with a binary adder/subtracter 89. Here, both the note frequency code data $\beta'$ and frequency modulation code data $\alpha'$ are expressed as binary code which are fed to the binary adder/subtracter 86 which has the same function as the binary adder/subtracter 86 in FIG. 21. Of the result data of the binary adder/subtracter 86, the upper (N−n)-bit data are fed to the ROM 87 which has the same function as the ROM 87 in the example of FIG. 21 for reading out the note frequency code data $\beta$. Lower n-bit data Y are fed to the binary adder/subtracter 89. To the binary adder/subtracter 89 is also fed data X which has a value equal to the frequency modulation code data $\beta$ in the case where frequency modulation is not done. The result data X±Y of the binary adder/subtracter 89 is provided as the frequency modulation code data $\alpha$.

The value of the data X, which is provided from the CPU 3, is thus selected to meet a condition $$\alpha = X \pm Y = X \cdot 2^{\frac{100}{1,200}} \tag{11}$$

For example, in case of n=8 so that the binary adder/subtracter 89 functions as an adder, if the data Y (which can assume values of "0" to "63") is "63", from the equation 11, $$X = 63 = X \cdot 2^{\frac{100}{1,200}}$$

Thus, a value "1,509" is selected as the value of the data X provided from the CPU 3.

In this example, signals lower than the semitone change linearly, but this gives rise to no problem in practice.

FIG. 23 shows an example, in which the binary adder/subtracter 89 in the example of FIG. 22 is replaced with a decoder 90. Here, the hardware construction is further simplified. The binary adder/subtracter 86 has the same function as the binary adder/subtracter 86 in the example of FIG. 22, and the ROM 87 has the same function as the ROM 87 in the example of FIG. 22. Of the result data from the binary adder/subtracter 86, lower n-bit data is fed to the decoder 90, while the output data Y of the decoder 90 and data X are provided as the frequency modulation code data.

Of the data X, the lower n-bit data is all "0" data. Thus, there holds a relation $$X + Y = X \cdot 2^{\frac{100}{1,200}} \tag{12}$$

The data y is thus given as $$Y = X \tag{13}$$

As an example, consider a case where n=6, so that the lower 6-bit data is all "0" while X is $$X = 1111000000 (= \text{"960"})$$

In this case, Y is "56" from equation 13. The decoder 90 may thus be constructed such that its outut (i.e., data Y) assumes a value of "0" to "56" according to the lower 6-bit data of the output of the binary adder/subtracter 86. This decoder output is added to the lower 6 bits of the data X to produce the frequency modulation code data $\alpha$. In this way, the tone pitch can be varied from 0 to 100 cent i.e., up to the maximum semitone, as the data Y is varied from "0" to "56".

As another example, if X is $$X = 1101000000 (= \text{"832"}),$$

Y is $0 < Y \leqq 48$.

Figure 24:
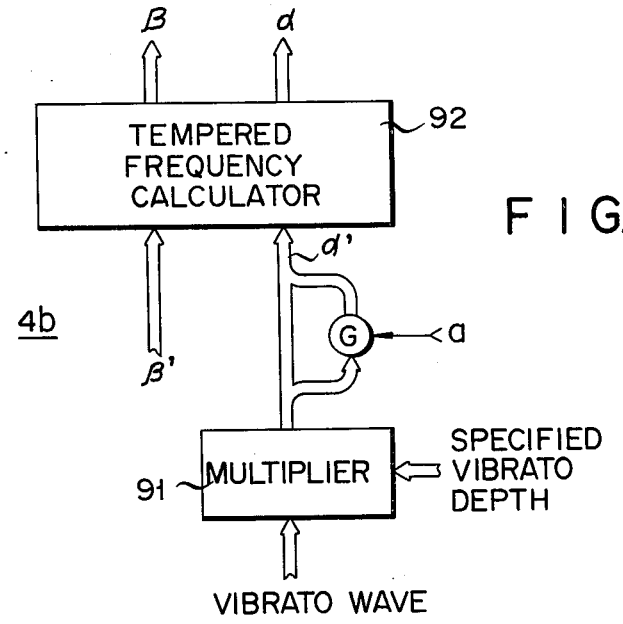

FIG. 24 shows an example, in which the frequency modulation code data $\alpha'$ is the product of a vibrato waveform signal and a vibrato depth designation signal. Here, the vibrato waveform signal is provided from a definite waveform generator (not shown) under the control of the CPU 3, while the vibrato depth designation signal is produced by operating a given switch in the switch section 2. The vibrato waveform signal and vibrato depth designation signal are multiplied by each other in a multiplier 91. Of the result data from the multiplier 91, lower bit side data corresponding to a semitone is fed to an average factor frequency arithmetic unit 92 through a gate circuit G, which is controlled for gating by a control signal a provided from the CPU 3. Upper bit side data of the result data is directly fed, together with the frequency modulation code data $\alpha'$, to the average factor frequency arithmetic unit 92. The note frequency code data $\beta'$ is further fed to the average factor frequency arithmetic unit 92. The average factor frequency arithmetic unit 92 may be the circuit shown in FIG. 21.

In this case, when the gate circuit G is disabled with a "0" signal supplied to it as the control signal a, the lower bit side data corresponding to the semitone in the frequency modulation code data $\alpha'$ is all "0". With this frequency modulation code data $\alpha'$ fed to the average factor frequency arithmetic unit 92, a vibrato waveform which varies semitone-wise can be obtained according to the note frequency code data $\beta'$ and frequency modulation code data $\alpha'$ provided from the average factor frequency arithmetic unit 92.

Figure 25:
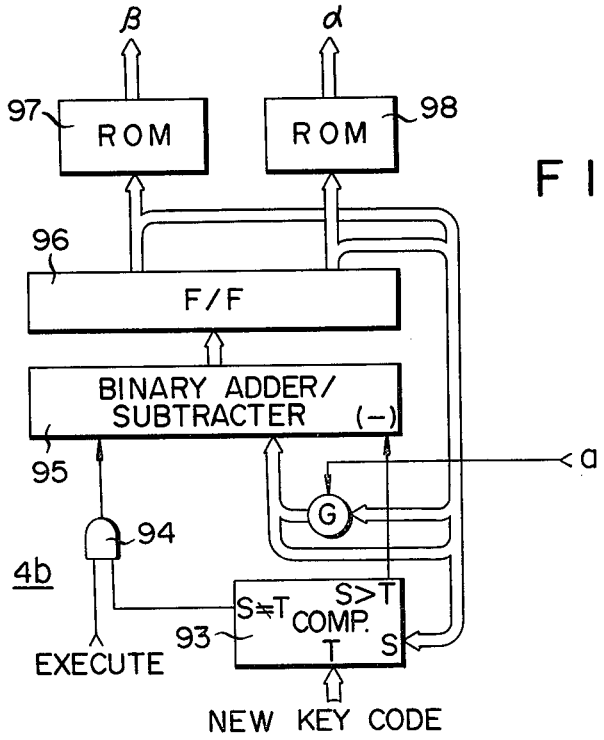

FIG. 25 shows an example, which permits portamento operation only at the time of monophonic performance. Here, a code NEW KEY CODE which is provided when a new key is turned on is fed to a terminal T of a comparator 93. At this time, a code corresponding to the previously turned-on key has been fed back from a flip-flop 96 to a terminal S of the comparator 93. The comparator 93 compares the magnitudes of the codes at the terminals T and S. If the code at the terminal T is less than the code at the terminal S, i.e., if the tone pitch of the tone of the new key is lower than that of the previous tone, a "1" signal is provided from a terminal S T to be fed to a control terminal (−) of the binary adder/subtracter 95, causing a subtracting operation of the binary adder/subtracter 95. If the code at the terminal T is greater than the code at the terminal S, i.e., if the tone pitch of the tone of the previous key is higher than that of the new key, a "0" signal is provided from a terminal S T to be fed to the control terminal (−) of the binary adder/subtracter 95, causing an adding operation of the binary adder/subtracter 95. Further, if the codes at the terminals T and S do not coincide, the comparator 93 provides a "1" signal from its terminal S T to enable an AND gate 94. If the two codes coincide, the comparator 93 provides a "0" signal to disable the AND gate 94. A signal EXECUTE is periodically provided to the AND gate 94. While the AND gate 94 is enabled, this signal is supplied as a "+1" signal or a "−1" signal to the binary adder/subtracter 95. Of N-bit data which is latched in the flip-flop 96, lower n-bit data corresponding to a semitone is coupled through the gate circuit G to the binary adder/subtracter 95. Upper (N−n)-bit data of the N-bit data is directly fed back to the binary adder/subtracter 95. The binary adder/subtracter 95 executes a "+1" or "−1" incrementing operation on the data from the flip-flop 96 every time the signal EXECUTE is supplied. The result data is provided to the flip-flop 96. Of the N-bit data provided from the flip-flop 96, the upper (N−n)-bit data is fed to a ROM 97, whereby the note frequency code data $\beta$ is read out from the ROM 97. The lower n-bit data of the N-bit data is fed to a ROM 98, whereby the frequency modulation code data is read out from the ROM 98. The gate circuit G is controlled for gating by the control signal a.

As is shown, with the construction of FIG. 25 the binary adder/subtracter 95 executes a subtracting operation if the tone pitch of the tone corresponding to a newly turned-on key is lower than that corresponding to the previously turned-on key while it executes an adding operation if the tone pitch of the new key is higher than that of the previous key. Thus, the portamento effect can be provided. If the control signal a is provided as a "0" signal, portamento effect varying for each semitone can be obtained.

Figure 26:
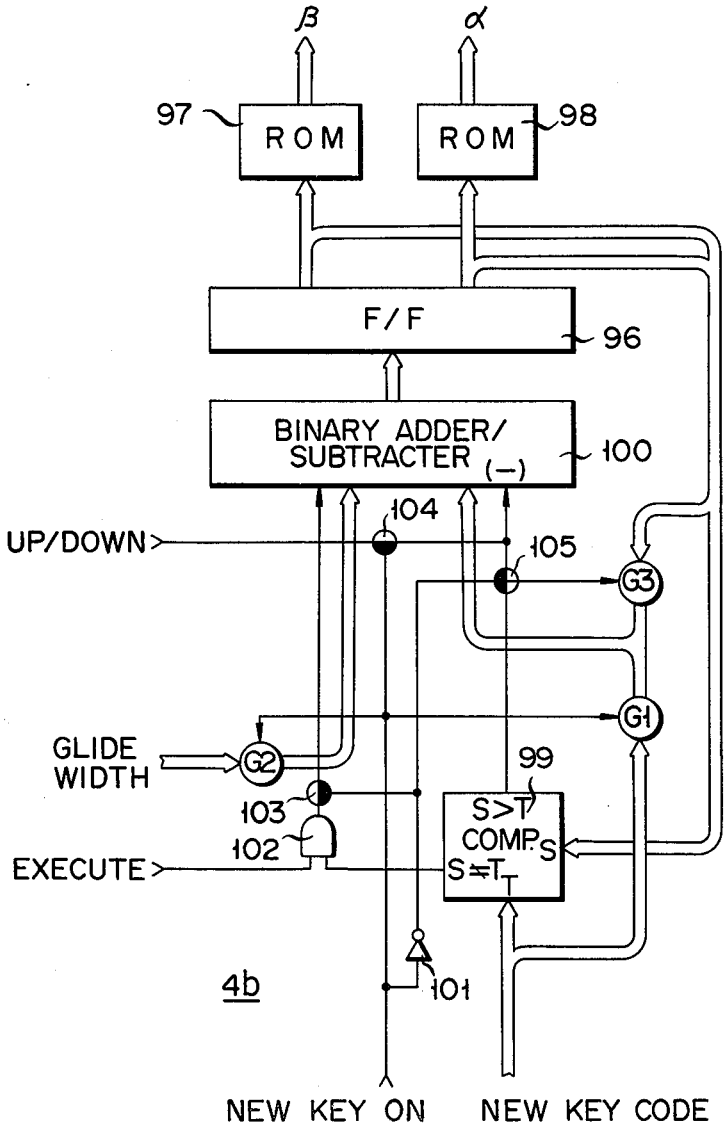

FIG. 26 shows an example, in which a glide effect can be provided. Here, when a new key is turned on, the corresponding code NEW KEY CODE is supplied directly to a terminal T of a comparator 99 and also to a binary adder/subtracter 100 through a gate circuit G1. At the same time, glide width data is supplied to the binary adder/subtracter 100 through a gate circuit G2. Further, a signal up/down is fed through a transfer gate 104 to a control terminal (−) of the binary adder/subtracter 100. The binary adder/subtracter 100 executes at this time a glide width subtracting operation with respect to the code NEW KEY CODE if the signal up/down is an "up" command (i.e., a "1" signal), while it executes a glide width adding operation with respect to the code NEW KEY CODE if the signal up/down is a "down" command (i.e., a "0" signal). The result data is fed to a flip-flop 96. After the key has been turned on, the result data latched in the flip-flop 96 is fed directly to a terminal S of the comparator 99 and is also fed to the binary adder/subtracter 100 through a gate circuit G3. Further, of the result data, upper (N−n)-bit data is fed to a ROM 97, whereby the tone frequency code data $\beta$ is read out from the ROM 97. Lower n-bit data of the N-bit data is fed to a ROM 98, whereby the frequency modulation code data $\alpha$ is read out from the ROM 98. A result signal obtained from the comparator 99 as a result of comparison of the input data to the terminals S and T of the comparator 99 is further fed from an S T terminal thereof through a transfer gate 105 to the control terminal (−) of the binary adder/subtracter 100. A signal EXECUTE is further supplied through an AND gate 102 and a transfer gate 103 to the binary adder/subtracter 100. Thus, after the key has been turned on, the binary adder/subtracter 100 executes an adding operation or a subtracting operation with respect to the result data from the flip-flop 96 every time the signal EXECUTE is supplied. If the comparator 99 detects the coincidence of the input data to its terminals S and T, the adding or subtracting operation of the binary adder/subtracter 100 is stopped to stop the operation of providing glide effect.

More particularly, if the two input data to the terminals S and T of the comparator 99 do not coincide, the comparator 99 provides a "1" signal from its S T terminal. If the two input data coincide, the comparator 99 provides a "0" signal from the same terminal. The "1" or "0" signal is fed to the AND gate 102. Further, when a key is turned on, a one-shot signal NEW KEY ON is supplied to the gate circuits G1 and G2 and transfer gate 104 to enable these gate circuits and the transfer gate. The signal NEW KEY ON is further fed to an inverter 101, the output of which is fed to the gate circuit G3 and transfer gates 103 and 105 to enable the gate circuit and transfer gates. The signal up/down and glide width data are provided when corresponding switches in the switch section 2 are operated.

Now, the operation that takes place when providing vibrato to a tone produced through frequency modulation will be described. In this case, the average factor frequency arithmetic section 4b, which may have various constructions as shown in FIGS. 20 to 26, executes an operation different from that in the case where no frequency modulation is done and produces the note frequency code data $\beta$ and data which is not constant but changes at all time, i.e., the frequency modulation code data $\alpha$, to the wave generator 5.

In the case of FIG. 20, of the note frequency code data $\beta$, and frequency modulation code data $\alpha'$ provided from the CPU 3 both as N-bit data, the lower n-bit data are fed to the binary adder/subtracter 83, the upper 4-bit data are fed as duodecimal code data to the duodecimal adder/subtracter 82, and the upper (N−n−4)-bit data is fed to the binary adder/subtracter 81. In the adder/subtracters 81 to 83, either the adding or subtracting operation is executed depending upon whether an add or subtract command is supplied from the CPU 3. In this case, the carry output from the binary adder/subtracter 83 is fed to the terminal $C_{in}$ of the binary adder/subtracter 82, and the carry output of the binary adder/subtracter 82 is fed to the terminal $C_{in}$ of the binary adder/subtracter 81. The result data from the binary adder/subtracter 81 and 82 are fed to the ROM 84, whereby the note frequency code data $\beta$ is read out from the ROM 84 according to the note of the operated key. Meanwhile, the result data of the binary adder/subtracter 83 is fed to the ROM 85, whereby the frequency modulation code data $\beta$ for varying the frequency of the produced tone up to the semitone according to the average factor is read out from the ROM 85. It will be seen from the equation 2 or 5 that with variations of the frequency modulation code data $\alpha$ the frequency $f_0$ of the tone produced is varied, whereby frequency modulation providing vibrato or the like can be obtained.

In the case of FIG. 21, both the note frequency code data $\alpha'$ and frequency modulation code data $\beta'$ are expressed as binary data, and the binary adder/subtracter 86 adds or subtracts the two code data $\beta'$ and $\alpha'$. Of the result data, the upper (N−n)-bit data is fed to the ROM 87, and the lower n-bit data is supplied to the ROM 88. Thus, the note frequency code data $\beta$ corresponding to the note is read out from the ROM 87, and the varying frequency modulation code data $\alpha$ is read out from the ROM 88.

In the case of FIG. 22, the binary adder/subtracter 86 adds or subtracts the note frequency code data $\beta'$ and frequency modulation code data $\alpha'$. Of the result data, the upper (N−n)-bit data is fed to the ROM 87, while the lower n-bit data Y is fed to the binary adder/subtracter 89. Thus, the note frequency code data $\beta$ is read out from the ROM 87 according to the note. Meanwhile, the data X which has the same value as the frequency modulation code data $\alpha$ when frequency modulation is not provided (a constant value) is provided from the CPU 3 and fed to the binary adder/subtracter 89. The data X is calculated according to the equation 11. Thus, frequency modulation code data $\alpha$ based on the result data X+Y or X−Y of the binary adder/subtracter 89 is obtained.

In the case of FIG. 23, the binary adder/subtracter 86, like the binary adder/subtracter 86 in the case of FIG. 22, receives the tone frequency code data $\beta'$, frequency modulation code data $\alpha'$ and add or subtract command. Of the result data, the upper (N−n)-bit data is fed to the ROM 87, and the lower n-bit data is fed to the decoder 90. Thus, the note frequency code data $\beta$ corresponding to the note is read out from the ROM 87. Meanwhile, the decoder 90 provides the data Y calculated according to the equation 13 regarding the data X having a value when the lower n-bit data is all "0". The data that is obtained by adding the data Y to the lower bit side data of the X data, is provided as the frequency modulation code data $\alpha$. Thus, frequency modulation is effected according to the frequency modulation code data $\alpha$ which varies according to the data Y.

In the case of FIG. 24, the depth of vibrato is designated by operating a corresponding switch in the switch section 2. When no semitone-wise vibrato is provided, a pertaining switch is correspondingly operated to provide a "1" signal as the signal a for enabling the gate circuit G. Thus, after the key has been turned on, the note frequency code data $\beta'$ for that key is provided and fed to the average factor frequency arithmetic section 92. In the multiplier 91, the vibrato waveform signal and vibrato depth designation signal are multiplied. Of the result data, the upper bit side data is directly fed to the average factor frequency arithmetic unit 92, while the lower bit side data corresponding to the semitone is fed as frequency modulation code data $\alpha'$ through the gate circuit G to the average factor frequency arithmetic unit 92. The average factor frequency arithmetic unit 92 thus executes the average factor frequency calculation in accordance with the operation of the circuit of FIG. 21, and provides the note frequency code data $\beta$ and frequency modulation code data $\alpha$. The vibrato thus changes with the same depth and same speed for all notes.

When providing semitone-wise vibrato, the pertinent switch is correspondingly operated to provide a "0" signal as the signal a so as to disable the gate circuit G. Thus, of the result data provided from the multiplier 91, the lower bit side data corresponding to the semitone is fed as all "0" data to the average factor frequency arithmetic unit 92. The frequency modulation code data $\alpha$ provided from said average factor frequency arithmetic unit 92 thus varies in value such as to provide semitone-wise vibrato.

The circuit in the case of FIG. 25 is operated when obtaining a portamento effect at the time of the monophonic performance. When a new key is turned on after the previous key has been turned off, the corresponding code NEW KEY CODE is provided and fed to a terminal T of the comparator 93. At this time, the code corresponding to the previously operated key prevails at the terminal S of the comparator 93. The comparator 93 thus compares the magnitudes of both the codes. When the tone pitch of the tone of the previous key is lower than that of the new key, the comparator 93 provides a "1" signal from its terminal S>T. This "1" signal is fed as a subtract command to the control terminal (−) of the binary adder/subtracter 95. Also, the comparator 93 provides a "1" signal from the terminal S≠T to enable the AND gate 94. Thus, every time a signal EXECUTE is fed through the AND gate 94 to the binary adder/subtracter 95, the binary adder/subtracter 95 executes a "−1" incrementing operation to decrement the code of the previous key by "1". It is assumed that the signal is "1". Thus, of the result data in the subtracting operation noted above, the upper (N - n)-bit data is fed to the ROM 97, while the lower n-bit data is fed to the ROM 98, whereby the note frequency code data $\beta$ and frequency modulation code data $\alpha$ are read out. In this case the frequency modulation code $\alpha$ progressively changes toward lower frequencies according to the average factor. If the signal a noted above is "0", the frequency modulation code data $\alpha$ changes semitone-wise toward lower frequencies. When the comparator 93 detects the coincidence of the two codes at the terminals A and T, it provides a "0" signal from its S≠T terminal to disable the AND gate 94, thus stopping the subtracting operation of the binary adder/subtracter 95. By the above operation, the portamento operation from the high to the lower tone side is completed.

If the tone pitch of the previous key is higher than the tone pitch of the new key, the comparator 93 provides a "0" signal from its terminal S T, and "0" is fed as an add command to the binary adder/subtracter 95. The binary adder/subtracter 95 operates a "+1" incrementing operation until the two data at the terminals S and T coincide. Accordingly, the note frequency code data $\beta$ corresponding to the note of the operated key is provided from the ROM 97, and the frequency modulation code $\alpha$ provided from the ROM 98 progressively changes toward higher frequencies according to the average factor. If a "0" signal is provided as the signal, the frequency modulation code data $\alpha$ changes semitone-wise toward increasing frequencies. The speed of change of notes is fixed over the whole range.

In the case of FIG. 26, to obtain an "up" glide effect, the pertinent switch in the switch section 2 is correspondingly operated. Also, the glide width is specified by the corresponding switch. When a key is turned on in this state, a one-shot signal NEW KEY ON (i.e., "1" signal) is provided to enable the gate circuits G1 and G2 and transfer gate 104. Thus, the binary adder/subtracter 100 functions as a subtracter when the one-shot signal NEW KEY ON is provided. With the key turned on as noted above, the code NEW KEY CODE is fed through the gate circuit G1 to the binary adder/subtracter 100. The glide width data is also fed to the binary adder/subtracter 100 through the gate circuit G2. The binary adder/subtracter 100 thus subtracts the glide width data from the code NEW KEY CODE. The result data is fed to the flip-flop 96.

With the appearance of the one-shot signal NEW KEY ON, the output of the inverter 101 is inverted to "1" to enable the transfer gates 103 and 105 and gate circuit G3. Thus, the result data is fed to the terminal S of the comparator 99, and is also fed to the binary adder/subtracter through the gate circuit G3. Subsequently, the comparator 99 compares the data at the terminals S and T and provides a "0" signal from its S T terminal. The "0" signal is fed as an add command through the transfer gate 105 to the control terminal (−) of the binary adder/subtracter 100. The comparator 99 also provides a "1" signal from its terminal S>T to enable the AND gate 102. The signal EXECUTE is thus passed through the AND gate 102 to be fed through the transfer gate 103 to the binary adder/subtracter 100. The binary adder/subtracter 100 thus executes a "+1" incrementing operation with respect to the result data noted above very time the signal EXECUTE is supplied. The upper (N−n)-bit data of the result data is fed to the ROM 97, while the lower n-bit data is fed to the ROM 98. Thus, the note frequency code data $\beta$ is read out from the ROM 97. Also, the frequency modulation code data a changing toward higher frequencies according to the average factor is read out from the ROM 98. Thus, the "up" glide effect can be obtained. When the comparator 99 detects the coincidence of the data at the terminals S and T, it provides a "0" signal from the terminal S T to disable the AND gate 102. Thus, the operation of providing the "up" glide effect is stopped.

To obtain the "down" glide effect, the pertinent switch is correspondingly operated. When a key is turned on in this state, in response to the one-shot signal NEW KEY CODE, the binary adder/subtracter 10 executes a glide width adding operation with respect to the code NEW KEY CODE. The result data is fed to the flip-flop 96. Subsequently, the binary adder/subtracter 100 executes a "−1" incrementing operation on the result data to decrement the same by "1" every time the signal EXECUTE is supplied. Thus, the note frequency code data $\beta$ is read out from the ROM 97, while the frequency modulation code data $\alpha$ changing toward lower frequencies according to the average factor is read out from the ROM 98. In this way, the "down" glide effect can be obtained. The speed of changing of notes is fixed over the whole gamut.

With the above embodiment of FIG. 19, the note frequency is determined through processing in the digital circuit, and it is possible to obtain uniform frequency modulation over the plus side and minus side through simple processing. Besides, since the portamento effect and glide effect can be readily provided, uniform frequency modulation over the plus and minus sides can be readily obtained according to the average factor. Thus, it is possible to obtain a very natural vibrato effect as well as natural portamento and glide effect. Further, the processing is simple so that the hardware construction can be simple, which contributes to the size reduction of the electronic musical instrument.

Figure 27:
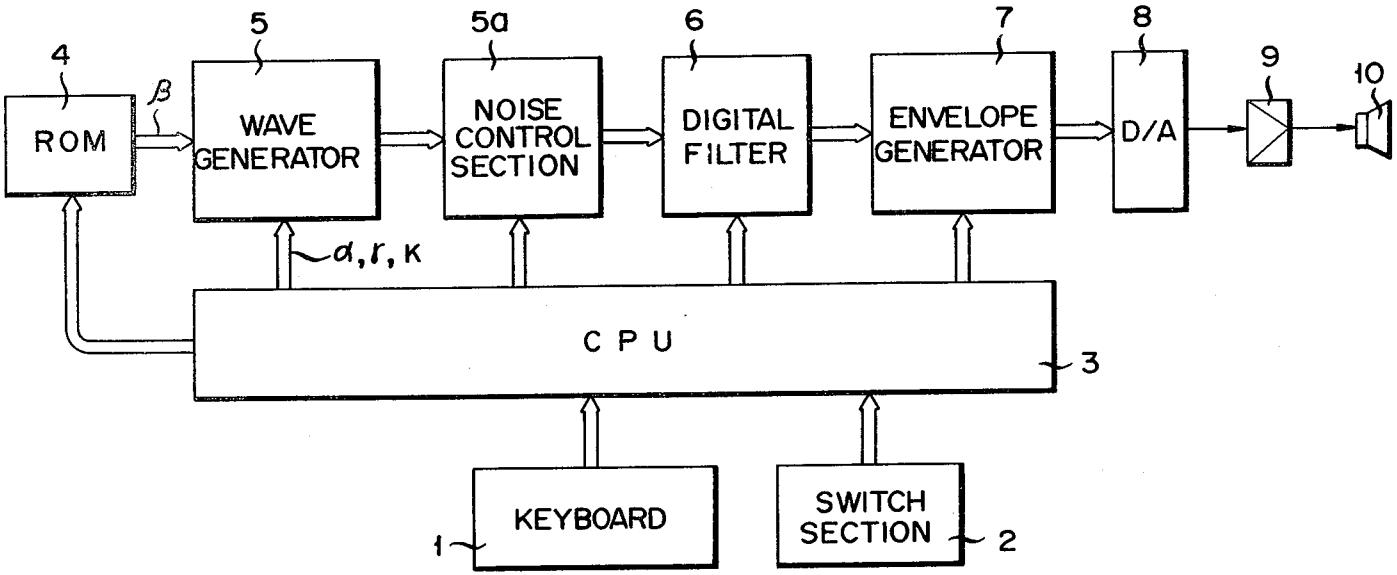
FIG. 27 is a system block diagram showing a further embodiment of the invention.

FIG. 27 is a block diagram showing a further embodiment, in which the tone color of the tone produced can be changed. Here a noise control section 5*a* is provided between the wave generator and digital filter 6. When changing the color tone, the noise control section 5*a* executes an arithmetic operation of adding or subtracting noise with respect to input waveform data from the wave generator 5 while determining the polarity of the waveform, i.e., whether the amplitude of the waveform data is positive or negative.

Figure 28A:
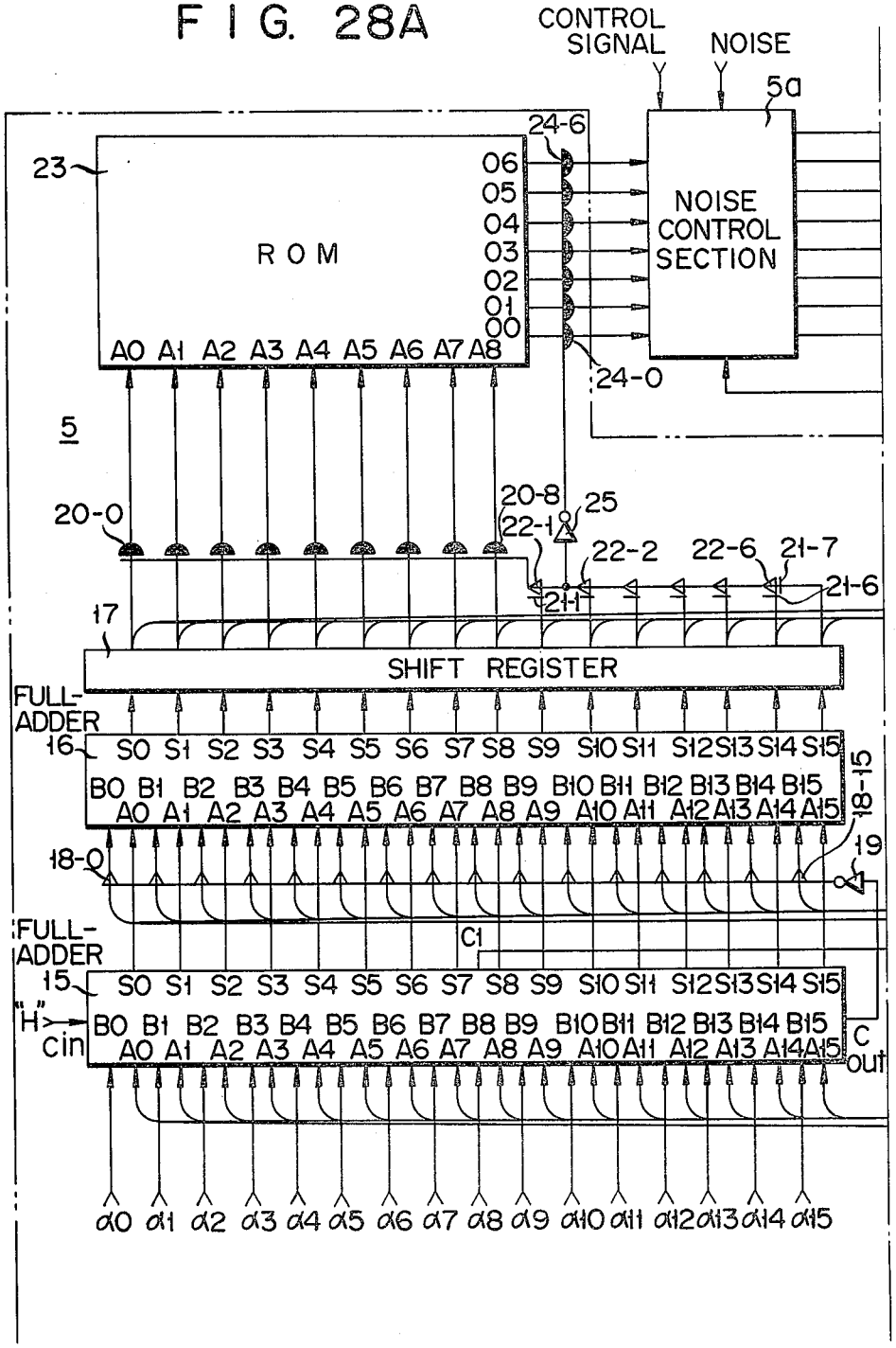
FIGS. 28A and 28B together form a circuit diagram showing a wave generator in FIG. 27.
Figure 28B:
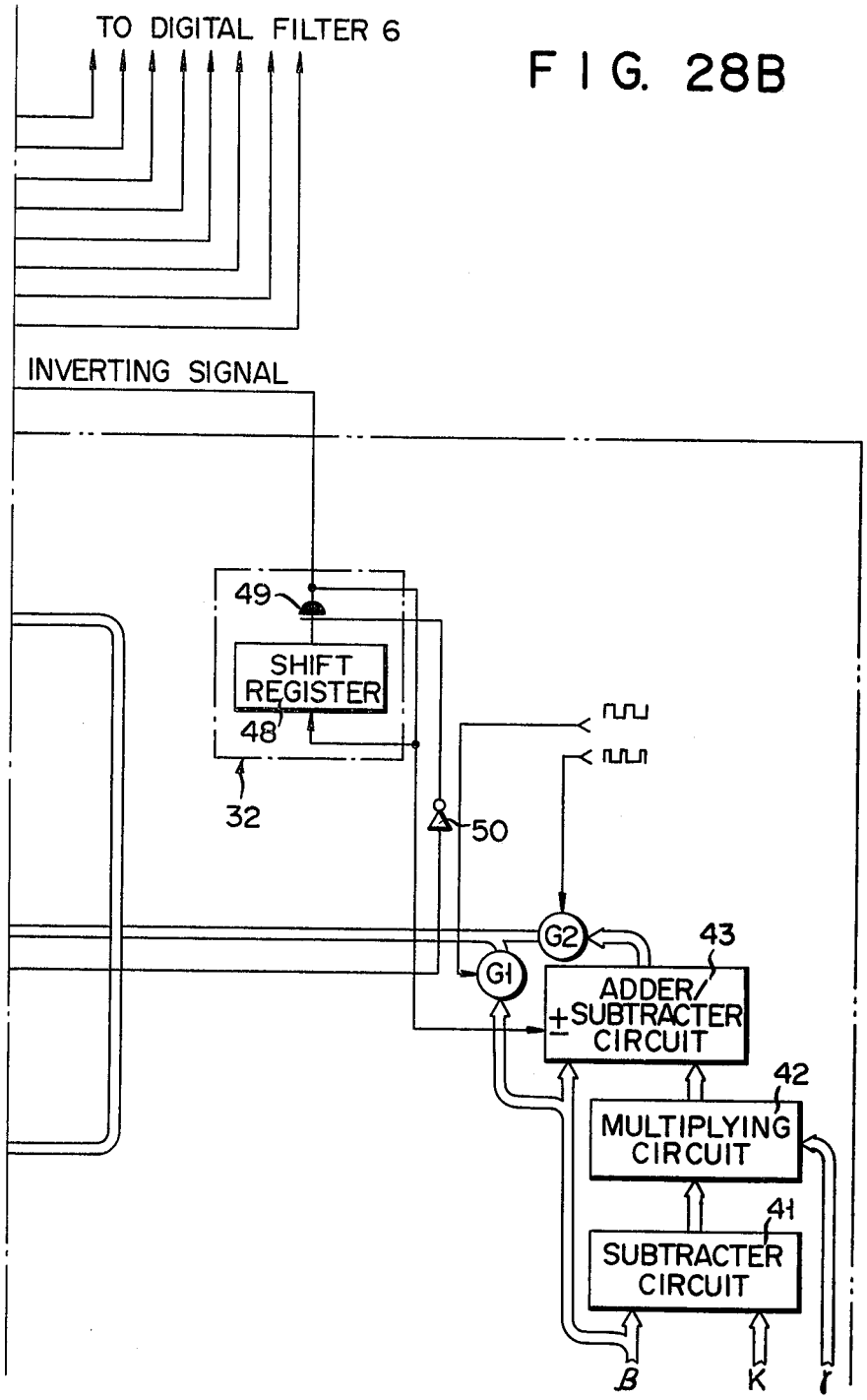

As shown in FIGS. 28A and 28B, the noise control section 5*a* receives the output of ROM 23 through OR gates 24-0 to 24-6. A control signal, an inverting signal and noise signal are further supplied to the noise control section 5*a*. The output of the noise control section 5*a* is fed to digital filter 6. The rest of the construction of this embodiment is the same as in the embodiment of FIGS. 2A and 2B.

Figure 29:
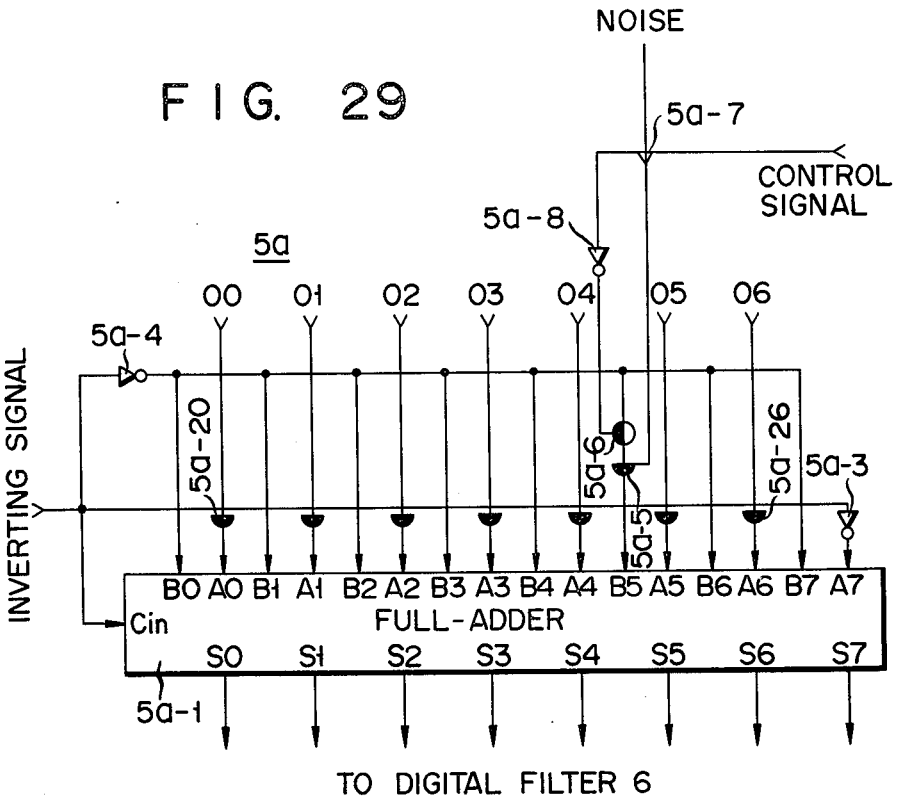
FIG. 29 is a circuit diagram showing a noise control section in FIG. 28.

FIG. 29 shows the construction of the noise control section 5*a* in detail. The output of exclusive OR gates 5*a*-26 to 5*a*-20 is fed to lower 7-bit A input terminals A6 to A0 of a full-adder 5*a*-1. The inverting signal noted above is fed through an inverter 5*a*-3 to the most significant bit A input terminal A7 of the full-adder 5*a*-1. The inverting signal is also fed through an inverter 5*a*-4 to B input terminals except for B input terminal B5 of the full-adder 5*a*. The output of an AND gate 5*a*7 is fed to the B input terminal B5. The inverting signal is further directly fed to a carry input terminal $C_{in}$ of the full-adder 5*a*-1. Data $O_6$ to $O_0$ are fed through the OR gates 24-6 to 24-0 to one input terminal of the respective exclusive OR gates 5*a*-26 to 5*a*-20. The inverting signal is fed to the other input terminal of these OR gates 5*a*-26 to 5*a*-20. The inverting signal is further fed through the inverter 5*a*-4 and a transfer gate 5*a*-6 to the OR gate 5*a*-5. The noise signal is fed through an AND gate 5-7 to the OR gate 5*a*-5. The transfer gate 5*a*-6 is controlled for gating by a signal fed from an inverter 5*a*-8 inverting the control signal from the CPU 3 in accordance with the state of a noise switch in switch section 2, which is operated when changing the tone color. The AND gate 5*a*-7 is controlled for gating directly by the control signal. The noise signal has its level randomly changed to "H" or to "L" when the noise switch is "on". The result data from S output terminals S7 to S0 of the full-adder 5*a*-1 is supplied to the digital filter 6.

Now, the operation will be described in connection with a case of changing the tone color of a tone by adding noise. In this case, a noise switch is first turned on together with a rectangular wave specifying switch in the switch section 2. As a result, a control signal of "1" level is supplied from the noise control section 5*a* to the CPU 3 to disable the AND gate 5*a*-7 and also disable the transfer gate 5*a*-6. Thus, a noise signal, the level of which can be randomly changed to "1", is fed to the B input terminal B5 of the full-adder 5*a*-1.

Now, the operation of the noise control section will be described for a case where the noise signal is "0" or "1" from the instant when the note frequency code data $\beta$ is set at the B input terminals of the full-adder 16 mentioned above till the instant when the result data of the cumulative subtracting operation with respect thereto becomes "1,024". During this time, 8-bit all "1" data prevails at the A input terminals of the full-adder 5*a*-1, and a "0" signal prevails at the carry input terminal $C_{in}$ of the full-adder 5*a*-1. Further, data "11011111" is supplied to the B input terminals when the noise signal is "0", while 8-bit all "1" data is supplied when the noise signal is "1". Thus, when the noise signal is "0", the result data fed from the full-adder 5*a*-1 to the digital filter 6 is "11011110". That is, data (amplitude value data) which is less than the data $O_6$ to $O_0$ fed to the A input terminals by "00100001" is supplied. When the noise signal is "1", the result data fed to the digital filter 6 is "11111110", that is, data less than the data $O_6$ to $O_0$ to the A input terminals by "1" is supplied. This means that the amplitude waveform produced is as shown by a solid line in FIG. 30 when the noise signal is "1" and as shown by a dashed line when the noise signal is "0" for the left side half of the wave, i.e., for the positive portion of the waveform with respect to the amplitude value "10000000". In other words, the produced waveform is represented by either one of the two amplitude data shown by the solid curve and dashed curve depending upon whether the noise signal is "0" or "1".

Figure 30:
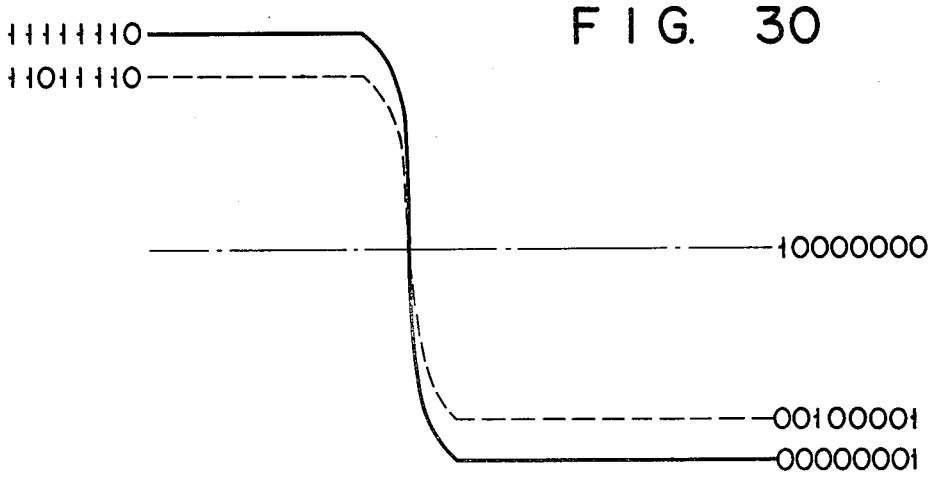
FIG. 30 is a graph for explaining the operation of the circuit of FIG. 29.

While the result data of the cumulative subtracting operation changes from "1,024" to "512", the amplitude data read out from the ROM 23 is directly fed as data $O_6$ to $O_0$ to the A input terminals A6 to A0 of the full-adder 5a-1. Also, a "1" signal is fed to the A input terminal A7, and a "0" signal is fed to the carry input terminal $C_{in}$. Further, data "11011111" is fed to the B input terminals when the noise signal is "0" while 8-bit all "1" data is fed to the B input terminals when the noise signal is "1". Thus, during this period, data which is less than the data to the A input terminals of the full-adder 5a-1 by "00100001" is fed to the digital filter 6 when the noise signal is "0" while data less than the data fed to the A input terminals by "1" is fed when the noise signal is "1", that is, the waveform as shown in FIG. 30 is obtained.

While the result data of the cumulative subtracting operation changes from "512" to "0", data as a result of inversion of the amplitude data $O_6$ to $O_0$ from the ROM 23 is fed to the A input terminals A6 to A0 of the full-adder 5a-1. Also, a "0" signal is fed to the input terminal A7, and a "1" signal is fed to the carry input terminal $C_{in}$. Further, 8-bit all "0" data is fed to the B input terminals when the noise signal is "0" while data "00100000" is fed to the B input terminals when the noise signal is "1". During this period, the data supplied to the digital filter 6 is thus greater than the data fed to the A input terminals by "1" when the noise signal is "0", while it is greater than the data to the A input terminals by "00100001" when the noise signal is "1". Thus, the right half, i.e., the negative amplitude portion, of the waveform in FIG. 30 is that shown by the solid line when the noise signal is "0", and is that shown by the dashed line when the noise signal is "1".

While the output of the shift register 17 changes from "0" to "1,024" as shown in (f) in FIG. 4, i.e., during the period from the instant when the note frequency code data $\beta$ is set afresh at the B input terminals of the full-adder 16 till the instant when the result data of the cumulative subtracting operation becomes "1,024", 8-bit all "0" data is fed to the A input terminals of the full-adder 5a-1, and the "1" signal is fed to the carry input terminal $C_{in}$. Further 8-bit all "0" data is fed to the B input terminals when the noise signal is "0", while data "00100000" is fed when the noise signal is "1". Thus, during this period the data supplied to the digital filter 6 is "00000001", i.e., data greater than the data fed to the A input terminals of the full-adder by "1" when the noise signal is "0", while it is "00100001", i.e., data greater than the data fed to the A input terminals by "00100001" when the noise signal is "1". Thus, the waveform as shown in FIG. 30 can be obtained.

While the result data in the cumulative subtracting operation changes from "1,024" to "512", data as a result of inversion of the data $O_6$ to $O_0$ from the ROM 23 is fed to the A input terminals A6 to A0 of the full-adder 5a-1, a "0" signal is fed to the A input terminal A7, and a "1" signal is fed to the carry input terminal $C_{in}$. Further, 8-bit all "0" data is fed to the B input terminals when the noise signal is "0", while data "00100000" is fed to the B input terminals when the noise signal is "1". Thus, the data supplied to the digital filter 6 during this period is greater than the input data to the A input terminals by "1" when the noise signal is "0", while it is greater than the input data to the A input terminals by "00100001" when the noise signal is "1".

Further, while the result data of the cumulative subtracting operation changes from "512" to "0", the data $O_6$ to $O_0$ from the ROM 23 is directly fed to the A input terminals A6 to A0 of the full-adder 5a-1, a "1" signal is fed to the A input terminal A7, a "0" signal is fed to the carry input terminal $C_{in}$, and a "0" signal is fed to the carry input terminal $C_{in}$. Further, data "11011111" is fed to the B input terminals when the noise signal is "0", 8-bit all "1" data is fed to the B input terminals when the noise signal is "1". The data supplied to the digital filter 6 during this time thus is less than the input data to the A input terminals by "00100001" when the noise signal is "0", while it is less than the input data to the A input terminals by "1" when the noise signal is "1".

As has been shown, when changing the tone color of the tone by adding noise, the noise is added such that its amplitude becomes smaller when the rectangular wave produced has position amplitudes, while it is added such that its amplitude becomes greater when the rectangular wave amplitude is negative. Thus, the amplitude of the tone produced will never exceed the capacity of the D/A converter 8.

Figure 31:
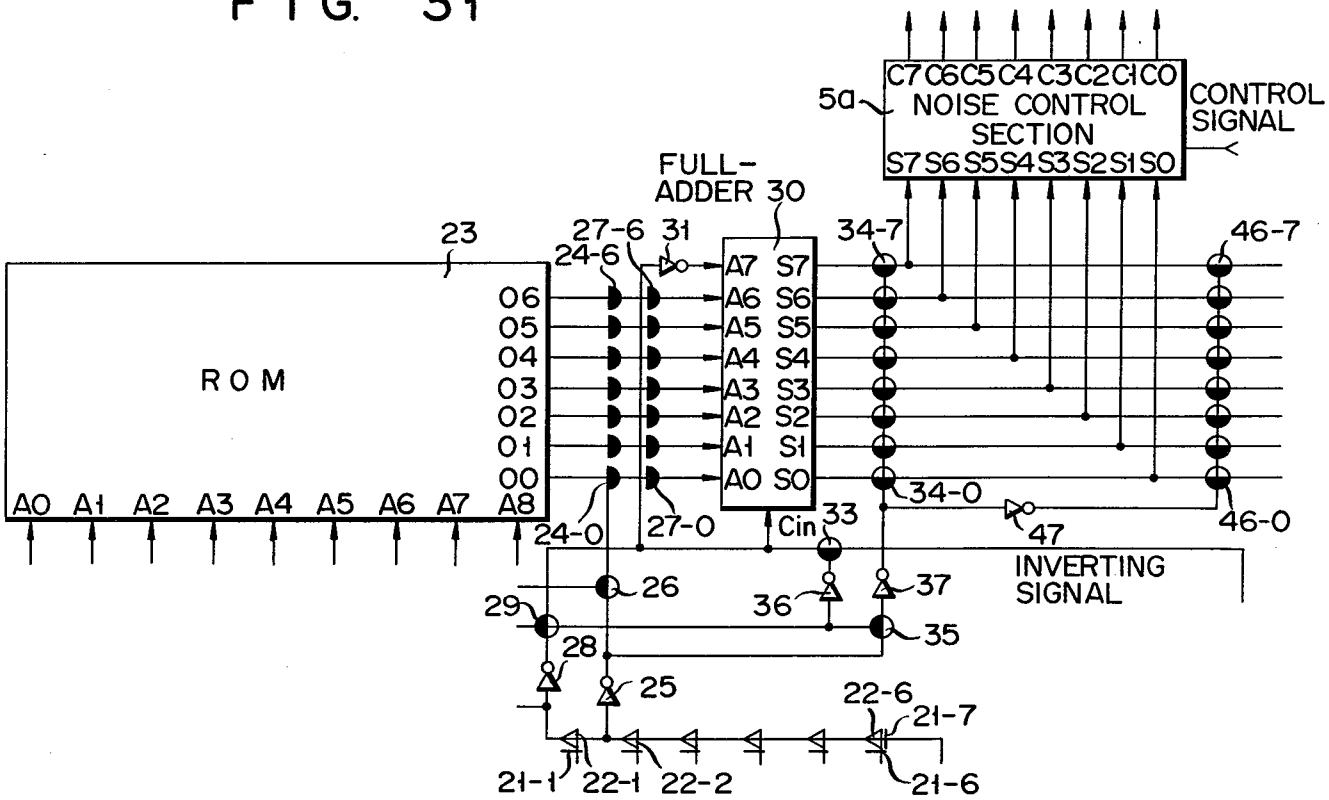
FIG. 31 is a circuit diagram showing a different example of the wave generator in FIG. 27.

The operation will now be described in connection with the case of a sawtooth wave with reference to FIGS. 31 to 33. FIG. 31 shows a circuit which is obtained by adding a certain circuit to the circuit of the wave generator 5 shown in FIGS. 28A and 28B so that sawtooth waves can be formed as well as rectangular waves and PWM waves. In FIG. 31, the same parts as those in FIGS. 28A and 28B are designated by like reference numerals and symbols, and their detailed description is omitted. The construction of the additional circuit in FIG. 31 will now be described.

Referring to FIG. 31, the output of the AND gate 22-2 is fed through inverter 25 and transfer gate 26 to OR gates 24-6 to 24-0 together with the amplitude data $O_6$ to $O_0$ read out from the ROM 23. The outputs of the OR gates 24-6 to 24-0 are fed to one input terminal of respective exclusive OR gates 27-6 to 27-0. The output of the AND gate 22-1 is fed through inverter 28 and transfer gate 29 to the other input terminal of the exclusive OR gates 27-6 to 27-0. The outputs of the exclusive OR gates 27-6 to 27-0 are fed to the A input terminals A6 to A0 of full-adder 30, which constitutes an inverter. The output of the AND gate 22-1 is further fed through inverter 28, transfer gate 29 and inverter 31 to the A input terminal A7 of the full-adder 30. The output of the AND gate 22-1 is further fed through inverter 28 and transfer gate 29 to the carry input terminal $C_{in}$ of the full-adder 30. Further, the output of an inverter to be described later is fed through a transfer gate 33 to the carry input terminal $C_{in}$. The data provided from the S output terminals S7 to S0 of full-adder 30 is fed through transfer gates 34-7 to 34-0 and the noise control section 5a to the digital filter 6. The output of the AND gate 22-1 is fed through inverter 28 and transfer gate 29 to the other input terminal of the individual exclusive OR gates 27-6 to 27-0. The outputs of the exclusive OR gates 27-6 to 27-0 are fed to the A input terminals A6 to A0 of the full-adder 30 serving as inverter. The output of the AND gate 22-1 is fed through inverter 28, transfer gate 29 and inverter 31 to the A input terminal A7 of the full-adder 30. The data from the S output terminals S7 to S0 of the full-adder 30 is fed through the transfer gates 34-7 to 34-0 and noise control circuit 5a to the digital filter 6.

Figure 32:
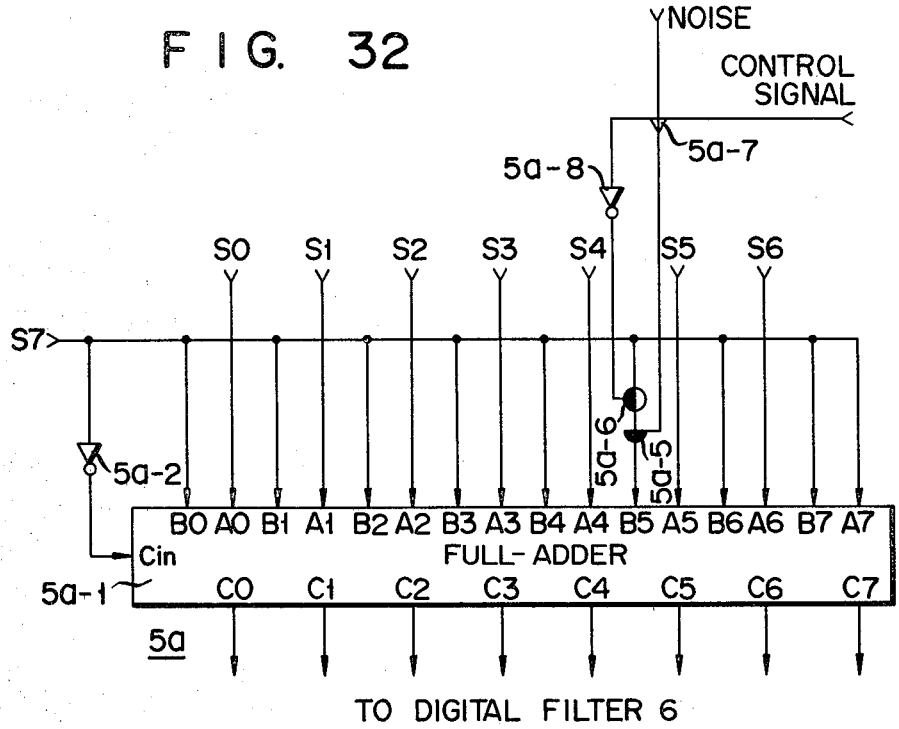
FIG. 32 is a circuit diagram showing a noise control section shown in FIG. 31.

FIG. 32 shows a specific construction of the noise control section 5a. The output data S7 to S0 from the full-adder 30 or dividing circuit 44 is fed through transfer gates 34-7 to 34-0 or transfer gates 46-7 to 46-0 to the A input terminals A7 to A0 of the full-adder 5a. Further, among the data S7 to S0 the data S7 (which is a sign bit data) is directly fed to the B input terminals except for the B input terminal B5. The output of an OR gate 5a-5 is fed to the B input terminal B5. The signal S7 is also fed through an inverter 5a-2 to the carry input terminal $C_{in}$. The signal S7 is further fed through the a transfer gate 5a-6 to the OR gate 5a-5. Noise signal is further fed through an AND gate 5a-7 to the OR gate 5a-5. The transfer gate 5a-6 is controlled for gating by a signal from an inverter 5a-8, to which a control signal provided from the CPU 3 with the operation of a noise switch in the section 2 when changing the tone color, is fed. The AND gate 5a-7 is directly controlled for gating by the control signal mentioned above. The result data from the full-adder 5a-1 is provided from its C output terminals C7 to C0 to the digital filter 6.

The operation in the case of forming a sawtooth wave with addition of noise will now be described with reference to FIG. 33. In this case, the noise switch is turned on together with the sawtooth wave specifying switch in the switch section 2. As a result, the control signal of "1" is provided from the CPU 3 to the noise control section 5a to enable the AND gate 5a-7 and disable the transfer gate 5a-6. Thus, a noise signal which changes irregularly between "0" and "1" levels is supplied to the input terminal B5 of the full-adder 5a-1. During the subsequent period from the setting of the note frequency code data in the full-adder 16 till the instant when the result data of the cumulative subtracting operation becomes "1,024", data "11011111" is fed to the B input terminals of the noise control section 5a while a "0" signal is fed to the carry input terminal $C_{in}$ when the noise signal is "0". Thus, the data supplied to the digital filter 6 is less than the data S7 to S0 fed to the A input terminals of the full-adder 5a-1 by "00100001". When the noise signal is "1", 8-bit all "1" data is fed to the B input terminals while "0" signal is again fed to the carry input terminal $C_{in}$. Thus, the data fed to the digital filter 6 is less than the data input to the a input terminals by "1".

While the data S7 to S0 reduces from "10000000" to 8-bit all "0", 8-bit all "0" data is fed to the B input terminals of the full-adder 5a-1 while a "1" signal is fed to the carry input terminal $C_{in}$ when the noise signal is "0". Thus, data greater than the data S7 to S0 by "1" is fed to the digital filter 6. When the noise signal is "1", data "00100000" is fed to the B input terminals while the "1" signal is again fed to the carry input terminal $C_{in}$. Thus, data as a result of addition of data "00100001" to the data S7 to S0 is supplied to the digital filter 6.

While the result data of the cumulative subtracting operation changes from "1,024" to "512", 8-bit all "0" data is fed to the B input terminals of the full-adder 5a-1 while a "1" signal is fed to the carry input terminal $C_{in}$ when the noise signal is "0". Thus, data as a result of addition of "1" to the data S7 to S0 is fed to the digital filter 6. When the noise signal is "1", data "00100000" is fed to the B input terminals while the "1" signal is fed to the carry input terminal $C_{in}$. Thus, data greater than the data S7 to S0 by "00100001" is fed to the digital filter 6.

While the result data of the cumulative subtracting operation changes from "512" to "0", data "11011111" is fed to the B input terminals of the full-adder 5a-1 while a "0" signal is fed to the carry input terminal $C_{in}$ when the noise signal is "0", as noted before. Thus, data less than the data S7 to S0 by "00100001" is fed to the digital filter 6. When the noise signal is "1", 8-bit all "1" data is fed to the B input terminals while a "0" signal is fed to the carry input terminal. Thus, data less than the data S7 to S0 by "1" is fed to the digital filter 6.

Figure 33:
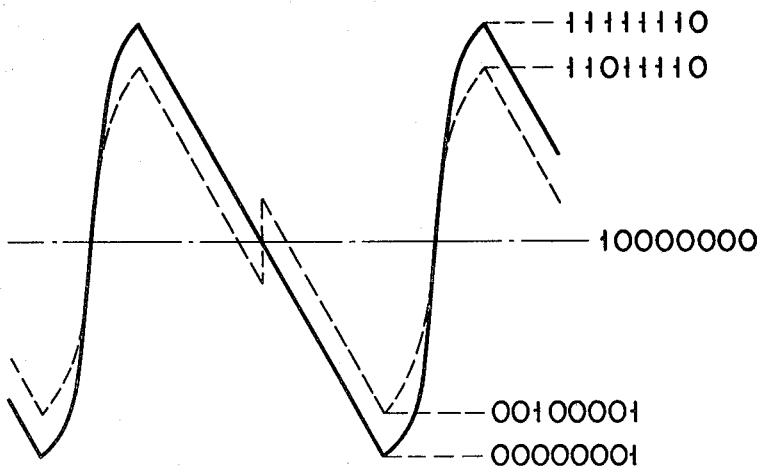
FIG. 33 is a graph showing amplitude level when noise is added to sawtooth waves.

In the waveform diagram of FIG. 33, the portion of the wave where the amplitude level is higher than the reference level corresponding to the data "100000000", i.e., where the amplitude level is positive, is as shown by the solid curve when the noise signal is "1" and as shown by the dashed curve when the noise signal is "0". The portion of the wave where the amplitude level is lower than the reference level, i.e., negative, is as shown by the solid curve when the noise signal is "0" and as shown by the dashed curve when the noise signal is "0". In case of adding noise to this sawtooth wave, like the case of the rectangular wave and PWM wave as mentioned above, the noise is added such that the amplitude of the sawtooth wave reduces when the amplitude is position while the amplitude increases when it is negative. Thus, the amplitude of the tone produced will never exceed the capacity of the D/A converter 8.

The operation of the wave generator 5 in FIG. 31 when producing the rectangular wave and PWM wave is substantially the same as the corresponding operation of the wave generator in FIGS. 28A and 28B, so it is not described here.

Figure 34:
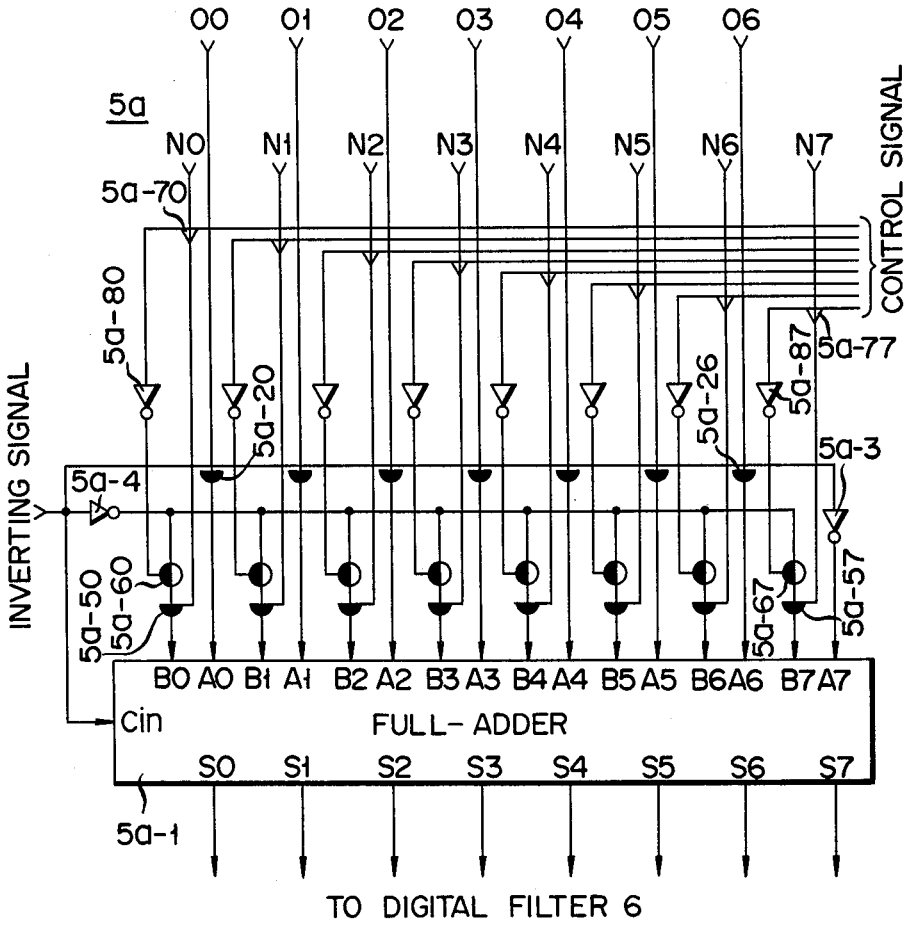
FIGS. 34 and 35 are circuit diagrams showing respective modifications of the noise control section in FIG. 31.
Figure 35:
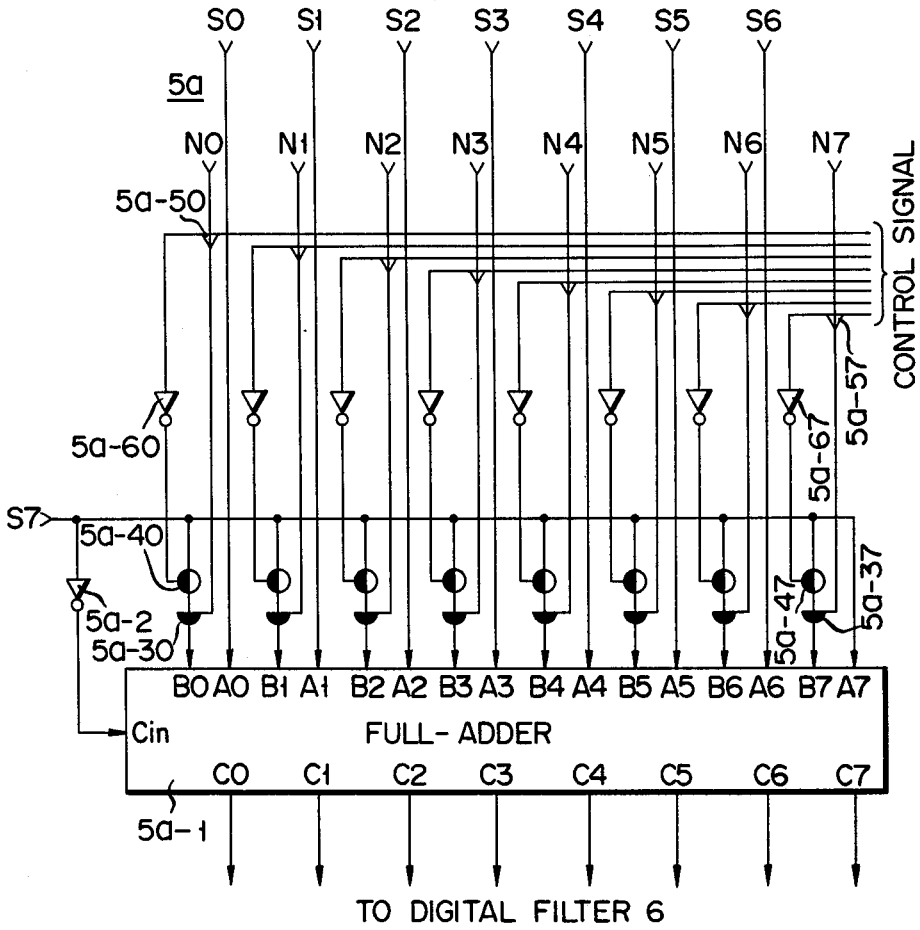

FIGS. 34 and 35 show examples of the noise control section 5a, in which the noise signal can be added to a variable extent. The example of FIG. 34 is a modification of the noise control section 52 shown in FIG. 29. Like parts in the Figure to those in FIG. 29 are designated by like reference numerals and symbols, and are not described. In this example, the noise signal is provided as 8-bit data N7 to N0. For varying the noise level, a slide switch is provided in addition to the noise switch in the switch section 2. The noise signal data N7 to N0 is coupled through AND gates 5a-77 to 5a-70 and OR gates 5a-57 to 5a-50 to the B input terminals B7 to B0 of full-adder 5a-1. The AND gates 5a-77 to 5a-70 are controlled for gating by corresponding bit data of an 8-bit control signal. The individual bit data of the control signal are also fed through respective inverters 5a-87 to 5a-80 to the control input terminal of respective transfer gates 5a-67 to 5a-60 for controlling the gating thereof. An inverting signal is fed through an inverter 5a-4 to the transfer gates 5a-67 to 5a-60, and the outputs of the transfer gates 5a-67 to 5a-60 are fed through OR gates 5a-57 to 5a-50 to the B input terminals B7 to B0 of the full-adder 5a-1.

When providing noise with the noise control section 5a of the above construction, the slide switch noted above is set to a given position corresponding to the desired noise level as well as turning on the noise switch. Thus, of the AND gates 5a-77 to 5a-70 those designated by the slide switch are enabled. As a result, of the outputs of the inverters 5a-87 to 5a-80 those corresponding to the enabled AND gates provide "0" output to disable corresponding ones of the transfer gates 5a-67 to 5a-60. Thus the given noise signal N7 to N0 are passed through the enabled AND gates and OR gates to the corresponding ones of B input terminals B7 to B0 of the full-adder 5a-1. The value of the signal data N7 to N0 varies digitally from the minimum value of 8-bit all "0" to the maximum value of 8-bit all "1" and also changes randomly as data within a range set for the slide switch. It is provided as a variable noise signal corresponding data $O_6$ to $O_6$ to the A input terminals of the full-adder 5a-1. Thus, tones of varying tone color corresponding to the level of the noise signal can be produced at any time.

When noise is not provided, the noise switch is held "off". With the noise switch turned off, all bit "0" data is provided as the control signal to disable all the AND gates 5a-77 to 5a-70, while all the transfer gates 5a-60 are all enabled. Thus, the noise signal N7 to N0 is not fed to the B input terminals of the full-adder 5a-1. Instead, the inverting signal is fed, so that the same operation as described above in connection with the noise control section 5a in FIG. 29 takes place.

The example of FIG. 35 is a modification of the noise control section 5a shown in FIG. 32. Like parts in the Figure to those in FIG. 32 are designated by like reference numerals and symbols and are not described. The noise signal here is again provided as 8-bit data N7 to N0. Again a slide switch for varying the noise level is provided in addition to the noise switch. The individual bit data of the noise signal N7 to N0 are fed through respective AND gates 5a-57 to 5a-50 and OR gates 5a-37 to 5a-30 to B input terminals B7 to B0 of the full-adder 5a-1. The AND gates 5a-57 to 5a-50 are controlled for gating by the corresponding bit data of 8-bit control signal. The individual bit data of the 8-bit control signal are coupled through respective inverters 5a-67 to 5a-60 to the control input terminal of respective transfer gates 5a-47 to 5a-40 to control the gating thereof. A signal S7 is further supplied to the transfer gates 5a-47 to 5a-40, and the outputs thereof are fed through respective OR gates 5a-37 to 5a-30 to the B input terminals B7 to B0 of full-adder 5a-1.

When providing noise with the noise control section 5a of the above construction, the slide switch is set to a given position corresponding to the noise level while turning on the noise switch. As a result, of the AND gates 5a-57 to 5a-50 those designated by the slide switch are enabled, so that of the inverters 5a-67 to 5a-60 those corresponding to the enabled AND gates provide an "0" output to disable the corresponding ones of the transfer gates 5a-47 to 5a-40. Also, noise signal N7 to N0 corresponding to the set state of the slide switch is provided and fed through the enabled AND gates and OR gates to the corresponding ones of the B input terminals B7 to B0 of the full-adder 5a-1. Thus, variable noise signal N7 to N0 is added to the data S7 to S0 fed to the A input terminals of the full-adder 5a-1.

As has been described, with the electronic musical instrument according to the invention for varying the tone color of a tone of a given tone waveform by adding a different tone waveform thereto, the addition of the different waveform is done by judging the polarity of the amplitude of the given tone waveform and effecting either addition or subtraction of the other tone waveform with respect to the given waveform depending upon the result of the judgement. Thus, the amplitude level of the tone waveform that is produced as a result of the provision of the other tone waveform to the given tone waveform will never exceed the capacity of the digital-to-analog converter, so that the desired tone can be reliably obtained. Further, when no other tone waveform is added, i.e., when the tone color is not changed, the amplitude level of the produced tone can be maximized to maximize the signal-to-noise ratio. Further, since it is possible to vary the amplitude level of the other tone waveform to be added, very effective tone color changes can be obtained.

What is claimed is:

1. A tone signal generating apparatus for an electronic musical instrument, comprising:

means for storing code data indicative of a plurality of musical note frequencies;

means coupled to said storing means for reading out given code data from said storing means according to an operated key on a keyboard;

arithmetic means coupled to said reading out means for obtaining an output comprising a plurality of bits indicative of the note frequency corresponding to the operated key, wherein said arithmetic means performs a predetermined arithmetic operation on the read-out code data;

control means for forming a tone signal having a predetermined waveform from said output of said arithmetic means comprising a plurality of bits; and interpolating means for interpolating a portion of said predetermined waveform of said tone signal in a region of a sharp change in the tone signal amplitude level, with a predetermined curvilinear function in each said region.

2. A tone signal generating apparatus for an electronic musical instrument according to claim 1, wherein said interpolating means includes a ROM in which at least part of a sine wave is stored, said interpolation being done using said sine wave.

3. The tone signal generating apparatus for an electronic musical instrument according to claim 1, wherein said interpolating means includes means for making the period of interpolation with said curvilinear function constant irrespective of the note frequency.

4. The tone signal generating apparatus for an electronic musical instrument according to claim 1, wherein said interpolating means includes means for varying the period of interpolation with said curvilinear function.

5. A tone signal generating apparatus for an electronic musical instrument, comprising:

means for storing code data indicative of a plurality of musical note frequencies;

means coupled to said storing means for reading out given code data from said storing means according to an operated key on a keyboard;

arithmetic means coupled to said reading out means and including means for supplying prescribed control data, and means for using the given code data read out from the storing means as an initial value data, for selectively cumulatively adding said prescribed control data to and cumulatively subtracting said prescribed control data from said initial value data, so as to obtain an output comprising a plurality of bits indicative of the note frequency corresponding to the operated key; and control means including means for supplying said code data from said storing means again to the arithmetic means when the output of said arithmetic means comprising a plurality of bits satisfies a predetermined condition, for forming a tone signal having a predetermined waveform.

6. The tone signal generating apparatus for an electronic musical instrument according to claim 5, which further includes frequency modulating means for providing frequency modulation on an output tone by periodically varying said control data supplied from said control data supplying means.

7. The tone signal generating apparatus for an electronic musical instrument according to claim 5 or 6, which further comprises tuning control means for varying the tone pitch of the output tone by varying said control data supplied from said control data supplying means.

8. A tone signal generating apparatus for an electronic musical instrument, comprising:

means for storing first frequency data corresponding to a change in frequency by a semitone or greater pitch interval, and second frequency data corresponding to a change in frequency within the semitone pitch interval;

means coupled to said storing means for reading out said first and said second frequency data from said storing means according to an operated key on a keyboard;

arithmetic means coupled to said reading out means for obtaining an output comprising a plurality of bits indicative of the note frequency corresponding to the operated key, said arithmetic means selectively cumulatively adding said second frequency data to and cumulatively subtracting said second frequency data from said first frequency data as an initial value; and control means including means for supplying said first frequency data again to the arithmetic means when the output of said arithmetic means comprising a plurality of bits satisfies a predetermined condition, for forming a tone signal having a predetermined waveform from said output comprising a plurality of bits.

9. The tone signal generating apparatus for an electronic musical instrument according to claim 8, wherein said first and said second frequency data supplied from said storing means have values corresponding to a tempered frequency.

10. The tone signal generating apparatus for an electronic musical instrument according to claim 8 or 9, wherein said storing means includes means for periodically varying said first and said second frequency data supplied to said arithmetic means when frequency modulation is specified.

11. The tone signal generating apparatus for an electronic musical instrument according to claim 8 or 9, wherein said storing means includes means for varying only said first frequency data supplied to said arithmetic means when frequency modulation is specified, wherein frequency modulation of the output tone is effected for every semitone.

12. The tone signal generating apparatus for an electronic musical instrument according to claim 8 or 9, wherein said storing means includes means for adding function data for frequency modulation to the first and the second frequency data corresponding to the note frequency to obtain modulated first and second frequency data supplied to said arithmetic means when frequency modulation is specified, wherein frequency modulation is done with a constant depth over a whole note frequency range.

13. The tone signal generating apparatus for an electronic musical instrument according to claim 8 or 9, wherein said storing means includes means for progressively varying said first and said second frequency data for the current note supplied to said arithmetic means, to first and second frequency data for a note to be newly produced when portamento performance is specified.

14. The tone signal generating apparatus for an electronic musical instrument according to claim 13, wherein said storing means varies only said first frequency data supplied to said arithmetic means when the portamento performance is specified, so that a portamento effect varying for each semitone is provided to the output tone.

15. The tone signal generating apparatus for an electronic musical instrument according to claim 8 or 9, wherein said storing means progressively varies frequency data obtained by selectively adding a predetermined value to and subtracting said predetermined value from basic frequency data corresponding to the frequency of a tone to be produced, to said first and second frequency data when glide performance is specified, so that said frequency data being varied is supplied as said first and said second frequency data to said arithmetic means.

16. The tone signal generating apparatus for an electronic musical instrument according to claim 15, wherein said storing means varies only said first frequency data supplied to said arithmetic means when the glide performance is specified, so that a glide effect varying for each semitone is provided to the output tone.

17. A tone signal generating apparatus for an electronic musical instrument, comprising:

means for storing code data indicative of a plurality of musical note frequencies;

means coupled to said storing means for reading out given code data from said storing means according to an operated key on a keyboard;

arithmetic means coupled to said reading out means for obtaining an output comprising a plurality of bits indicative of the note frequency corresponding to the operated key wherein said arithmetic means performs a predetermined arithmetic operation on the read-out code data; and control means including means for generating a tone signal having a predetermined waveform from said output of said arithmetic means comprising a plurality of bits, means for discriminating the polarity of the amplitude value of the generated tone signal, means for generating a different waveform signal, and means for selectively causing addition and subtraction of said tone signal and different waveform signal depending upon the result of the discrimination.

18. The tone signal generating apparatus for an electronic musical instrument according to claim 17, wherein said different waveform signal represents noise.

19. The tone signal generating apparatus for an electronic musical instrument according to claim 17, which further includes means for varying the level of said different waveform signal.

* * * * *

UNITED STATES PATENT AND TRADEMARK OFFICE

CERTIFICATE OF CORRECTION

PATENT NO. : 4,479,411

DATED : October 30, 1984

INVENTOR(S) : Masanori Ishibashi by Masayuki ISHIBASHI

It is certified that error appears in the above-identified patent and that said Letters Patent is hereby corrected as shown below:

COLUMN 2, line 35, after "section in" change "FIG. 28" to --FIGS. 28A and 28B--;

COLUMN 3, line 66, after "output terminal" change "S51" to --S15--;

COLUMN 4, line 16, before "is read out" change "25-0" to --24-0--.

Signed and Sealed this

*Fourth* Day of *June 1985*

[SEAL]

*Attest:*

DONALD J. QUIGG

*Attesting Officer* *Acting Commissioner of Patents and Trademarks*